US006963713B2

(12) United States Patent
Isomura et al.

(10) Patent No.: US 6,963,713 B2
(45) Date of Patent: Nov. 8, 2005

(54) DEVELOPER SUPPLY CONTAINER WITH A PLURALITY OF FEEDING PROJECTIONS

(75) Inventors: Tetsuo Isomura, Abiko (JP); Yutaka Ban, Tokyo (JP); Yusuke Yamada, Moriya (JP); Kazuhiko Omata, Shizuoka-ken (JP); Junko Yoshikawa, Toride (JP); Hironori Minagawa, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 11 days.

(21) Appl. No.: 10/420,735

(22) Filed: Apr. 23, 2003

(65) Prior Publication Data

US 2004/0052553 A1 Mar. 18, 2004

(30) Foreign Application Priority Data

Apr. 24, 2002 (JP) ..... 2002-122131
Mar. 6, 2003 (JP) ..... 2003-059491

(51) Int. Cl.[7] ..... G03G 15/08
(52) U.S. Cl. ..... 399/262; 222/DIG. 1
(58) Field of Search ..... 399/119, 252, 399/254, 258, 262; 222/DIG. 1

(56) References Cited

U.S. PATENT DOCUMENTS

| | | | | | |
|---|---|---|---|---|---|
| 4,611,730 | A | | 9/1986 | Ikesue et al. | 222/167 |
| 5,235,389 | A | * | 8/1993 | Kikuchi et al. | 399/263 |
| 5,257,077 | A | | 10/1993 | Peters, Jr. et al. | 355/260 |
| 5,565,973 | A | | 10/1996 | Fujishiro et al. | 355/326 R |
| 5,768,662 | A | * | 6/1998 | Sugihara et al. | 399/258 |
| 5,774,772 | A | * | 6/1998 | Kai et al. | 399/260 |
| 5,802,432 | A | * | 9/1998 | Coffey et al. | 399/110 |
| 5,890,040 | A | | 3/1999 | Matsuoka et al. | 399/262 |
| 5,918,095 | A | | 6/1999 | Huang | 399/263 |
| 5,970,292 | A | * | 10/1999 | Miller | 399/262 |
| 6,131,008 | A | | 10/2000 | Kanamori et al. | 399/263 |
| 6,298,208 | B1 | | 10/2001 | Kawamura et al. | 399/262 |
| 6,314,261 | B1 | | 11/2001 | Omata et al. | 399/258 |
| 6,438,345 | B1 | | 8/2002 | Ban et al. | 399/262 |
| 6,470,163 | B1 | | 10/2002 | Minagawa | 399/256 |
| 6,493,516 | B2 | | 12/2002 | Murakami et al. | 399/9 |
| 2002/0071698 | A1 | | 6/2002 | Isomura et al. | 399/263 |
| 2002/0106215 | A1 | | 8/2002 | Ban et al. | 399/120 |
| 2002/0122676 | A1 | | 9/2002 | Yamada et al. | 399/263 |

FOREIGN PATENT DOCUMENTS

| | | |
|---|---|---|
| EP | 1 233 311 A2 | 8/2002 |
| JP | 6-337586 | 12/1994 |
| JP | 7-44000 | 2/1995 |
| JP | 7-99442 | 4/1995 |
| JP | 8-1531 | 1/1996 |
| JP | 8-44183 | 2/1996 |
| JP | 10-254229 | 9/1998 |
| JP | 10-260574 | 9/1998 |
| JP | 2000-214669 | 8/2000 |
| JP | 2000-267410 | 9/2000 |

* cited by examiner

*Primary Examiner*—Hoan Tran
(74) *Attorney, Agent, or Firm*—Fitzpatrick, Cella, Harper & Scinto

(57) ABSTRACT

A developer supply container supplies a developer detachably set in an image forming apparatus. The developer supply container includes a main body for containing the developer; a discharge opening, which is provided in the main body, for discharging the developer; and a plurality of feeding projections, which are disposed so as to project from a curved inner surface of the main body, for feeding the developer in the main body toward the discharge opening with rotation of the main body. Each of the projections is linear without being twisted, wherein adjacent ones of the plurality of feeding projections include portions, which overlap each other as seen in a direction of an axis of rotation of the main body.

6 Claims, 22 Drawing Sheets

DEVELOPER SUPPLY CONTAINER WITH A PLURALITY OF FEEDING PROJECTIONS

FIELD OF THE INVENTION AND RELATED ART

The present invention relates to a developer supply container for supplying an image forming apparatus employing an electrophotographic or electrostatic recording method, with developer.

As the developer for an image forming apparatus such as an electrophotographic copying machine or an electrophotographic printer, developer in the state of fine powder has long been used. After the developer in the main assembly of an image forming apparatus is entirely consumed, the image forming apparatus is provided with a fresh supply of developer, with the use of a developer supply container.

Since developer is in the form of fine powder, there has been the problem that while an operator is supplying an image forming apparatus with a fresh supply of developer, the developer scatters, contaminating the image forming apparatus, and adjacencies thereof, as well as the operator. Thus, various methods for disposing a developer supply container with a small outlet, in the main assembly of an image forming apparatus, in such a manner that the developer is discharged as necessary, by a small amount, from the developer supply container through the small outlet thereof, has been proposed, and some of them have been put to practical use. In the case of these methods, it is rather difficult to automatically and reliably discharge the developer solely relying on the natural force, that is, the gravitational force. Therefore, some means for conveying the developer, while stirring it, is necessary.

There have been various widely known developer supply containers equipped with a stirring-conveying member, which is disposed within the container. In the case of these conventional developer supply containers, the torque necessary to drive the stirring-conveying member is substantial, although it varies depending on the component count and the amount of the developer in the container. Further, when the developer in the container is in a certain condition, the torque required to drive the stirring-conveying member is unexpectedly large. Recently, therefore, developer supply containers of a new type have become mainstream. These new developer supply containers are provided with a single or plurality of projections or ribs for conveying developer, which are integral parts of the containers. The developer is discharged as the developer supply containers are rotated. Some of these developer supply containers are directly rotated, and others are mounted in a rotary type developing apparatus so that they are orbitally moved as the rotary type developing apparatus is rotated.

For example, the developer supply containers disclosed in Japanese Laid-open Patent Applications 7-44000 and 10-260574 comprise: a cylindrical bottle; a single or plurality of spiral ribs placed on the internal surface of the bottle; a small developer outlet positioned roughly in the center of one of the end walls of the bottle; and a guiding portion placed on the internal surface of the bottle, next to the same end wall as the end wall having the developer outlet. As the developer supply container itself is rotated, the developer therein is conveyed toward the outlet by the spiral ribs on the internal surface of the bottle, and then, is lifted to the outlet by the guiding portion placed next to the outlet, being thereby discharged from developer supply container.

The developer supply containers disclosed in Japanese Laid-open Patent Applications 6-337586 and 2,000-214669 comprise: a cylindrical bottle; a single or plurality of spiral ribs placed on the internal surface of the bottle; and a small outlet placed in the cylindrical wall of the bottle. As the developer supply container itself is rotated, the developer therein is conveyed toward the outlet by the spiral ribs in the bottle, and then, is discharged from the developer supply container through the outlet in the cylindrical wall.

The developer supply container disclosed in Japanese Patent Application 8-1531 is roughly in the form of a cylindrical bottle, which has a spiral continuous rub extending on the internal surface of the bottle. As the bottle itself is rotated, the toner therein is conveyed by the spiral rib in the bottle. This patent application publication also discloses a modification of the above described developer supply container, in which instead of the above described continuous spiral rib, a plurality of discontinuous spiral ribs, or a plurality of spirally aligned pins or plates are disposed.

The developer supply container disclosed in Japanese Laid-open Patent Application 10-254229 comprises: a cylindrical bottle; a single or plurality of spiral ribs placed on the internal surface of the bottle; and a combination of a small developer outlet and a screw positioned at one end of the bottle. This developer supply container is mounted into a rotary type developing apparatus, in such a manner that it is prevented from rotating about its axial line. Thus, as the rotary type developing apparatus is rotated, this developer supply container is moved in a manner to orbit about the rotational axis of the rotary type developing apparatus, and the developer therein is conveyed to the screw by the spiral ribs in the bottle, being thereby conveyed to the outlet by the screw to be eventually discharged from the developer supply container.

The developer supply containers disclosed in Japanese Laid-open Patent Application 8-44183 comprises: a plurality of developer guiding ribs disposed in parallel to the rotational direction of the developer supply container to conveyed the developer in the developer supply container to the developer outlet in the peripheral wall of the container proper. This developer supply container is mounted in a rotary type developing apparatus, in such a manner that it is not rotatable about its axial line. As the rotary type developing apparatus is rotated, the developer supply container is orbitally moved about the rotational axis of the rotary type developing apparatus. As a result, the developer in the developer supply container is conveyed toward the outlet by the internal ribs of the container proper, and then, is discharged from the developer supply container.

However, the above described developer supply containers in accordance with the prior arts suffer from the following problems.

The developer supply containers disclosed in Japanese Laid-open Patent Applications 7-44000, 10-260574, 6-337586, 2,000-214669, and 10-254229, which have a single or plurality of internal spiral ribs, do not have a single or plurality of active internal stirring members. Therefore, if the developer in any of these developer supply containers is agglomerated into developer particles of larger sizes by the vibrations during the shipment of the developer supply container, or agglomerates into developer particles of larger sizes while the developer supply container is left unattended for a long period time in a high temperature and high humidity environment, the developer particles of larger sizes are conveyed to the developer outlet without being un-agglomerated. As a result, the outlet is partially, or sometimes entirely, blocked by the particles of the agglomerated developer, reducing the rate of the developer discharge from the developer supply container. This problem is particularly evident in the case of the developer supply containers, the outlet of which is in the cylindrical wall portion of the developer supply container.

Moreover, the developer supply containers having the internal spiral ribs suffer from problems related to their manufacture. That is, when molding them using an injection molding method, some portions of the spiral ribs constitute the so-called undercut portions (undercut means protrusive or recessive portion of metallic mold or molded product itself, which interferes with removal of molded product from mold), making it necessary to fill the undercut portions with resin; in other words, resin is wasted. As a result, not only is the cost of the developer supply container material increased, but also the internal volume of the developer supply container is reduced.

Further, if a blow molding method, or a stretch blow molding method is used to mold the developer supply containers, the choices of the resinous material for the developer supply container are limited to those compatible with the blow molding method or stretch blow molding method, for example, PET (polyethylene-terephthalate), PVC (polyvinyl chloride), HDPE (high density polyethylene), LDPE (low density polyethylene), and PP (polypropylene). When it comes to the matter of incombustibility or flame resistance, the material selection is particularly difficult. That is, there are no flame resistant versions of HDPE, LDPE, and PP on the market. PVC is flame resistant, but it is not usable because of its environmental impact. There are flame resistant versions of PET, but the usage of this material limits the selection of a molding method to injection blow molding methods. The molds for an injection blow molding method are expensive. Therefore, the usage of an injection blow molding method makes the unit cost of a developer supply container rather high, since each type of developer supply container is not manufactured by a number large enough to offset the high cost of the molds.

In the case of the structure disclosed in Japanese Patent Application Publication 8-1531, a plurality of ribs are spirally aligned with the provision of intervals. Therefore, while the developer is conveyed, a certain portion of the developer falls through the intervals, failing to be further conveyed by the adjacent rib. In other words, this structure is inferior in terms of developer conveyance efficiency.

The developer supply containers disclosed in Japanese Laid-open Patent Application 10-254229 comprises the screw for discharging the developer, which is located at one end of the container. Thus, its component count is greater, and therefore, its cost is higher.

The developer supply container structure disclosed in Japanese Laid-open Patent Application 8-44183 is rather difficult to apply to those developer supply containers which are relatively long in terms of axial direction; its application to such a developer supply container reduces the angle of the ribs, which results in the reduction of the developer conveyance efficiency.

SUMMARY OF THE INVENTION

The primary object of the present invention is to provide a developer supply container superior in developer stirring performance to a developer supply container in accordance with the prior arts.

Another object of the present invention is to provide a developer supply container superior in developer conveyance efficiency to a developer supply container in accordance with the prior arts.

Another object of the present invention is to provide a developer supply container lower in manufacture cost to a developer supply container in accordance with the prior arts.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described in detail with reference to the appended drawings. However, the measurements, materials, and shapes of the structural components in the following embodiments, and their relative positions should be optimally altered depending on the structures of the apparatuses to which the present invention is applied, and the various conditions related thereto. In other words, unless specifically stated, the following embodiments of the present invention are not intended to limit the scope of the present invention.

(Embodiment 1)

Next, the first embodiment of the present invention will be described with reference to the appended drawings. First, referring to FIG. 1, the structure of an example of an electrophotographic copying machine, into which the developer supply container in the first embodiment of the present invention is mounted will be described.

(Electrophotographic Image Forming Apparatus)

Figure 1:
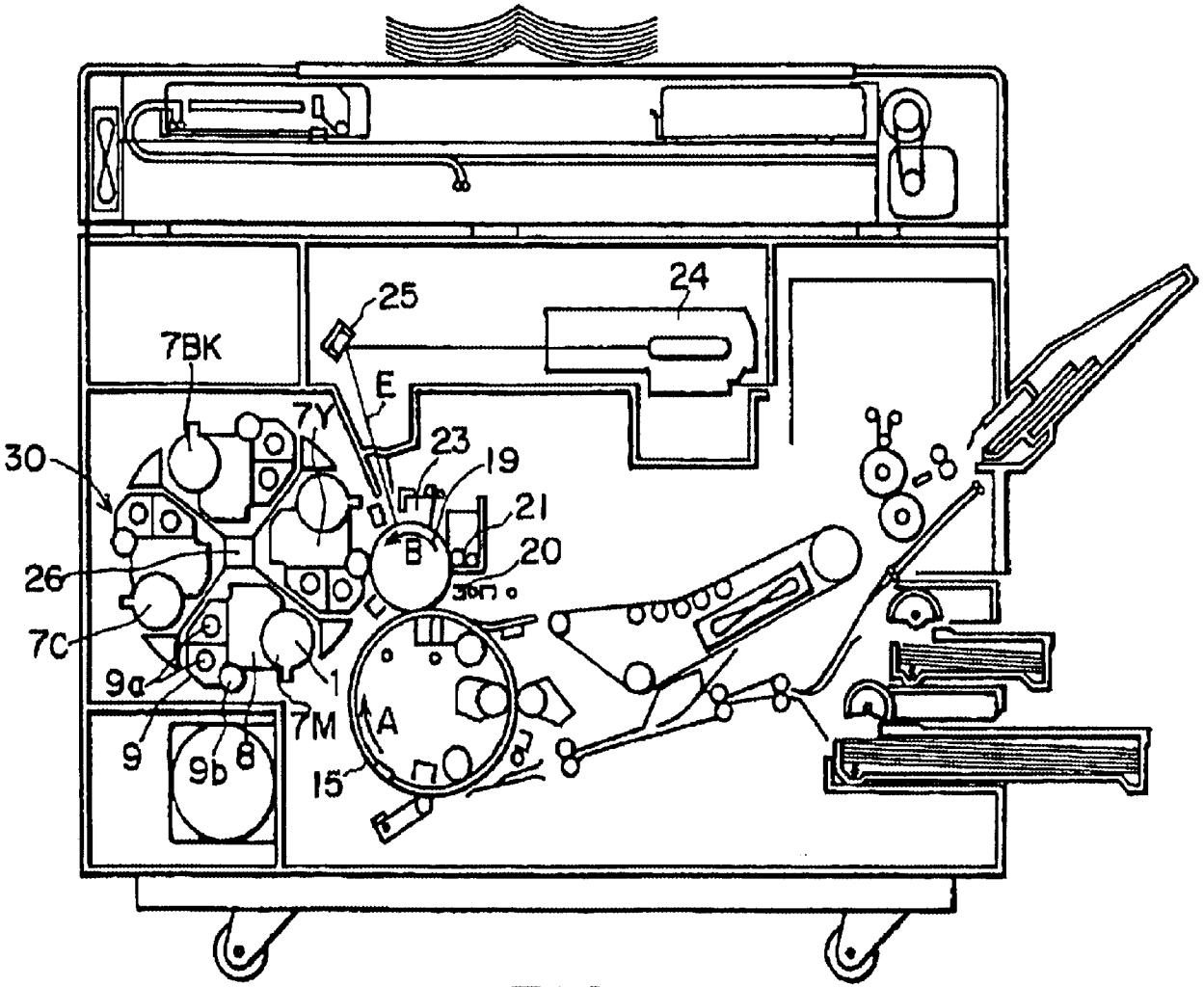
FIG. 1 is a sectional view of an image forming apparatus comprising a rotary type developing apparatus in which a single or plurality of developer supply containers are mounted.

FIG. 1 is a sectional view of an image forming apparatus internally holding the developer supply container in this embodiment. To describe first the structure of the latent image forming portion of the apparatus, a photoconductive drum 19 is disposed in such a manner that its peripheral surface remains in contact with a transfer drum 15, and that it is rotatable in the direction indicated by an arrow mark B in the drawing. The image forming apparatus also comprises a discharging device 20, a cleaning means 21, and a primary charging device 23, which are disposed in the listed order, in terms of the upstream-to-downstream direction with respect to the rotational direction of the photoconductive drum 19. Further, the image forming apparatus comprises: an exposing means 24, for example, a laser beam scanner, for forming an electrostatic latent image on the peripheral surface of the photoconductive drum 19; an exposure light reflecting means 25, for example, a mirror; etc.

The image forming apparatus also has a rotary type developing apparatus 30 as a developing means, which is immediately next to the latent image forming portion, the central component of which is the photoconductive drum 19. The structure of the rotary type developing apparatus 30 is as follows. That is, the rotary type developing apparatus 30 comprises a rotary 26, which is a frame rotatable in a predetermined direction. It is disposed so that its periphery is virtually in contact with the peripheral surface of the photoconductive drum 19. The internal space of the rotary 26 is divided, in terms of its rotational direction, into four chambers in which four different developing devices are mountable, one for one, to develop (visualize) the electrostatic latent images formed on the peripheral surface of the photoconductive drum 19. The four different developing devices are a developing device 7Y for developing a latent image into a yellow toner image, a developing device 7M for developing a latent image into a magenta toner image, a developing device 7C for developing a latent image into a cyan toner image, and a developing device 7Bk for developing a latent image into a black tone image.

As the above described rotary 26 is rotated, these four different developing devices are sequentially moved to a position (corresponding to where developing device 7Y is in FIG. 1) where the developing devices sequentially contact the photoconductive drum 19 to develop (visualize) the latent images corresponding thereto. The four developing devices are the same in structure, comprising a developer supply container 1, a developer inlet portion 8, and a developing device proper 9. In operation, the developing device proper 9 is supplied with developer, by the developer supply container 1, through the developer inlet portion 8, and develops the electrostatic latent image on the photoconductive drum 19.

The developer inlet portion 8 of the developing device 9 is structured so that not only does it receive and store the developer discharged from the developer supply container 1 by the orbital movement of the developer supply container 1 caused by the rotation of the rotary type developing apparatus 26, but also, it supplies the developer to the developing device 9 by a predetermined amount in response to the demand from the developing device 9. Each developing device 9 has a pair of developer conveying members 9*a*, which are disposed in the developing device and are opposite in the direction in which they convey the developer. Each developing device 9 also has a development sleeve 9*b*, which internally holds a magnet and is rotationally supported by its shaft. In operation, a magnetic brush is formed by attracting the mixture of the toner particles and carrier particles to the peripheral surface of the development sleeve 9*b*, and the toner particles adhering to magnetic particles are supplied to the photoconductive drum 19.

(Developer Supply Container)

Figure 2:
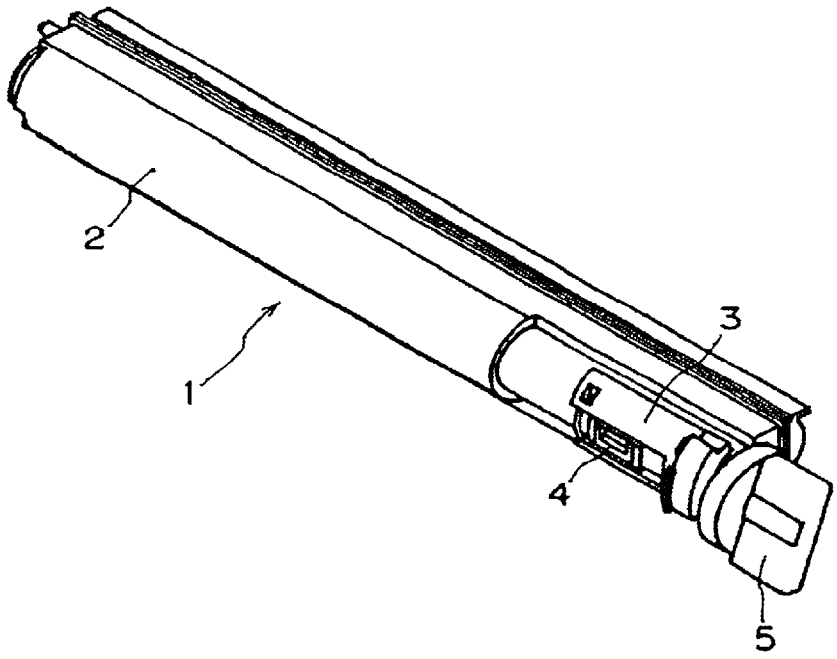
FIG. 2 is a perspective view of the developer supply container in the first embodiment of the present invention.

Referring to FIG. 2, designated by a referential numeral 1 is a cylindrical hollow developer supply container. The developer supply container 1 in this embodiment comprises a container main assembly 2, a shutter 3, a sealing member 4, and a knob 5.

(Container Main Assembly)

Figure 3:
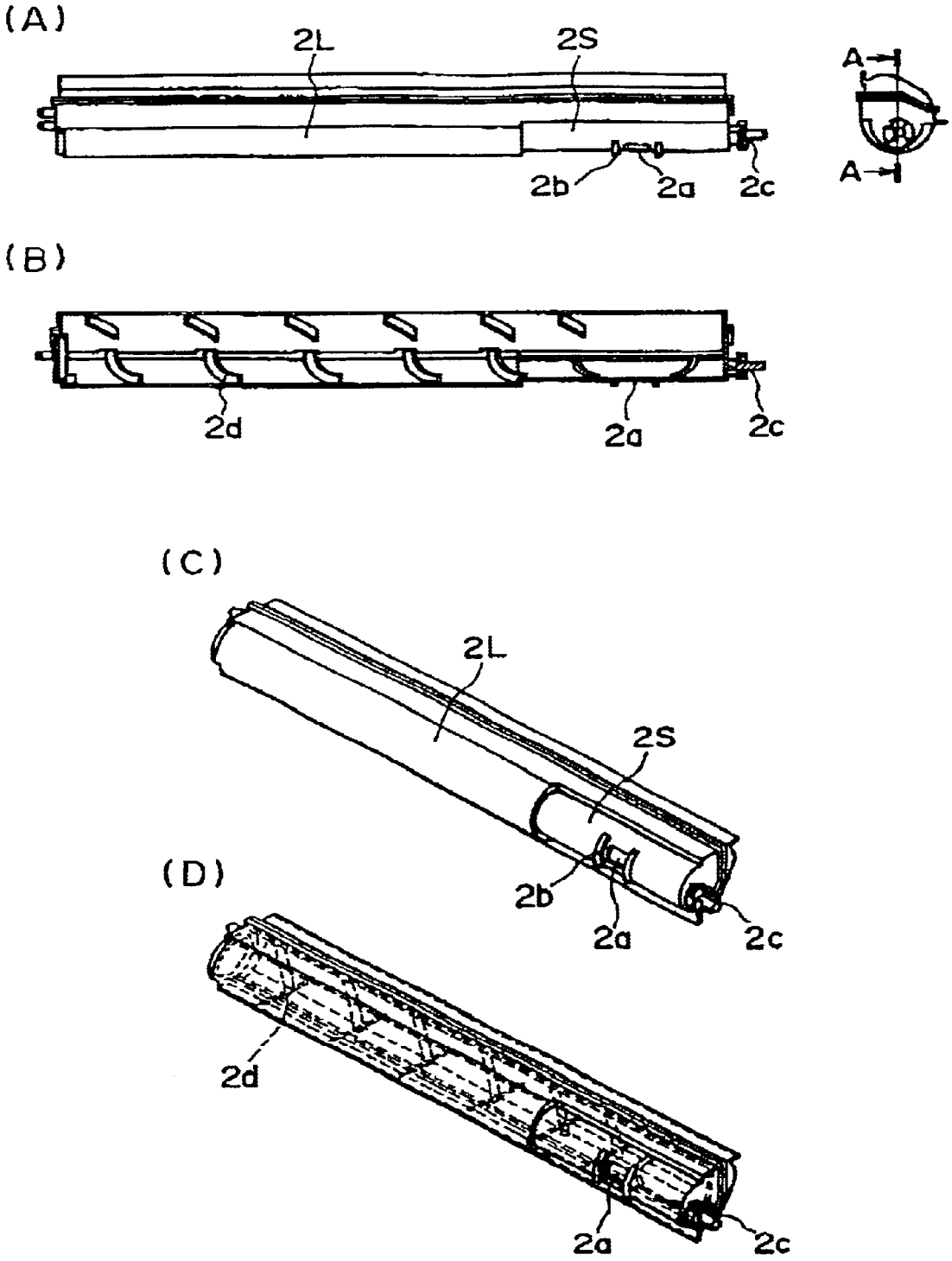
FIGS. 3(A), 3(B), 3(C), and 3(D) are a front view, sectional view parallel to the end panels thereof, perspective view, and perspective phantom view, of the main assembly of the developer supply container, respectively.

Referring to FIG. 3, the structure of the container main assembly 2 will be described. FIGS. 3(A), 3(B), and 3(C) are a front view, sectional view parallel to the end panels thereof, perspective view, and perspective phantom view, of the main assembly of the developer supply container, respectively.

The container main assembly 2 has a developer outlet 2*a*, a shutter guide 2*b*, a knob guide 2*c*, and a plurality of conveyance ribs 2*d*.

As for the shape of the container main assembly 2 in terms of the sectional view, it is noncircular. More specifically, it looks as if it was formed by attaching a parallelepiped to a semicircle. The length of the container main assembly 2 is approximately 350 mm. The container main assembly 2 has two sections in terms of its lengthwise direction, one section being smaller in diameter than the other. The diameter of the semicircular portion of the section with the smaller diameter is 25 mm and has the developer outlet 2*a*.

Giving the container main assembly 2 the above described shape, that is, such a shape that its cross sectional shape perpendicular to the lengthwise direction of the main assembly 2 becomes a shape other than a circular shape, makes it possible to best utilize the limited internal space of the rotary type developing apparatus into which the developer supply container 1 is mounted. In other words, it can increase the amount of the developer which can be filled into each developer supply container, while leaving the shape of the rotary type developing apparatus as it is.

Figure 4:
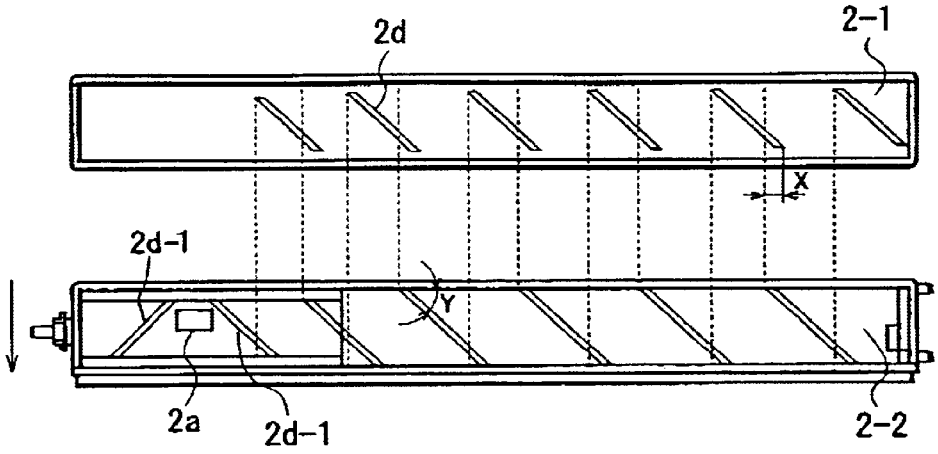
FIG. 4 is a drawing for describing the top and bottom members of the developer supply container in the first embodiment, as seen from the direction in which metallic molds are removed.
Figure 5:
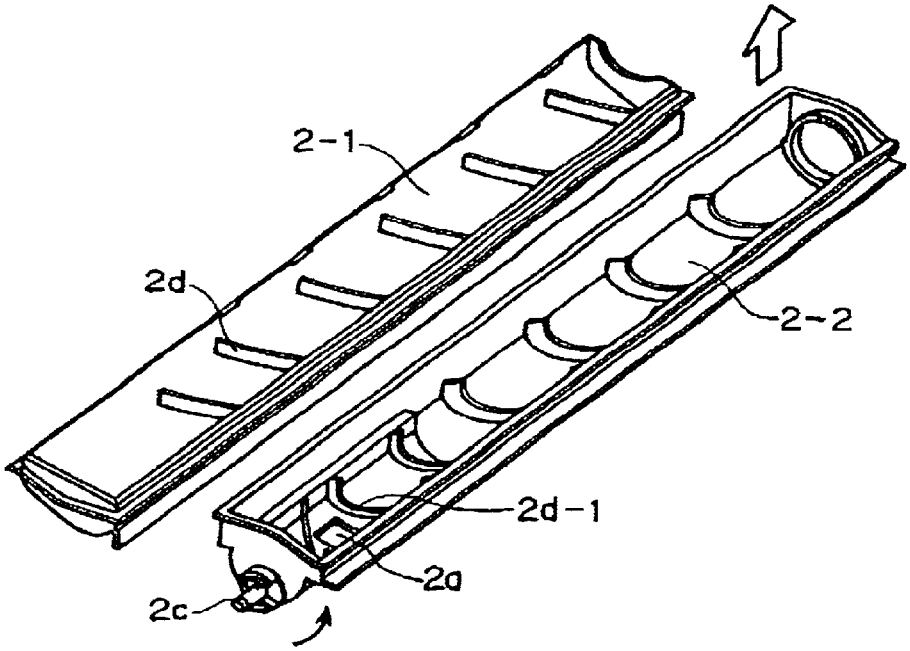
FIG. 5 is a drawing for describing the structures of the top and bottom members of the main assembly of the developer supply container in the first embodiment of the present invention.

The container main assembly 2 in this embodiment comprising the top and bottom halves 2-1 and 2-2 is manufactured using the following method. First, the top and bottom halves 2-1 and 2-2 are separately molded, and then, are welded to each other by an ultrasonic welding method (FIGS. 4 and 5).

(Developer Outlet)

The opening of the developer outlet 2*a* is rectangular, and its size is 10 mm×15 mm. It is in the peripheral wall of the container main assembly 2, being positioned 40 mm inward of one of the end walls, in terms of the lengthwise direction of the container main assembly 2. The developer in the container main assembly 2 is discharged through the developer outlet 2*a* into the corresponding developing device of the main assembly of an image forming apparatus.

Placing the developer outlet 2*a* in the peripheral wall of the container main assembly 2 can reduce the amount of the developer which cannot be discharged from the container main assembly 2, compared to a developer supply container having the developer outlet in one of its end walls.

Further, making the measurement of the developer outlet 2*a*, in terms of the lengthwise direction, shorter than the entire length of the container main assembly 2 can reduce the amount of the contamination traceable to the developer adhesion.

(Shutter Guides)

The shutter guides 2*b* are disposed next to the developer outlet 2*a* of the container main assembly 2, and are a pair of parallel ribs shaped so that their cross sections look like a key. The shutter 3 is engaged with these shutter guides 2*b* so that it can be moved about the axial line of the aforementioned semicircular portion of the container main assembly 2, following the curvature of the semicircular portion.

(Knob Guide)

The knob guide 2*c* is a disk-like rib, and is located at one of the lengthwise end portions of the container main assembly 2. The knob 5 is attached to the container main assembly 2 by engaging the claw portion (unshown) of the knob 5 with the knob guide 2*c*.

(Conveyance Ribs)

The container main assembly 2 has a plurality of conveyance ribs 2*d* for conveying the developer in the container main assembly 2 toward the developer outlet 2*a*. The conveyance ribs 2*d* are erected in parallel on the internal surface of the peripheral walls of the container main assembly 2, which are curved with respect to the direction perpendicular to the lengthwise direction of the container main assembly 2. More specifically, the plurality of conveyance ribs 2*d* are grouped into two sets: the top and bottom sets separated in terms of the circumferential direction perpendicular to the lengthwise direction of the container main assembly 2. In this embodiment, the heights of the conveyance ribs belonging to the larger diameter section of the container main assembly 2 are 5 mm, whereas the heights of the conveyance ribs belonging to the smaller diameter section of the container main assembly 2 are 2.5 mm. The two sets of conveyance ribs are attached to the top and bottom members 2-1 and 2-2 of the container main assembly 2, respectively. The number of the conveyance ribs of the top member 2-1 is 6 and that of the bottom member 2-2 is 7 (FIGS. 4 and 5).

Organizing the conveyance ribs 2*d* into the above described two sets, or the top and bottom sets separated in terms of the circumferential direction perpendicular to the lengthwise direction of the container main assembly 2, as well as providing a gap between adjacent two conveyance ribs, makes it possible to efficiently loosen or fluff the body of developer so that the developer can be smoothly discharged from the developer outlet 2*a*.

Further, the container main assembly 2 in this embodiment can be manufactured by bonding the individually formed top and bottom members. In other words, the container main assembly 2 can be assembled from the minimum number of components, and therefore, its manufacture cost is lower.

(Top and Bottom Members of Container Main Assembly)

FIG. 4 is a drawing for describing the top and bottom members of the developer supply container, as seen from the direction in which metallic molds are removed during the molding of the top and bottom members 2-1 and 2-2 of the container main assembly 2. The rotational direction of the developer supply container is as indicated by an arrow mark in FIG. 4.

All of the conveyance ribs 2*d*, except for one, of the top and bottom members of the container main assembly are tilted so that the developer outlet side end of each rib will be on the trailing side with respect to the direction in which the container main assembly is orbitally moved. Next, the angle of these conveyance ribs will be described in detail with reference to the bottom member 2-2 of the container main assembly 2 shown in FIG. 4.

Referring to FIG. 4, in the case of the conveyance ribs of the bottom member 2-2 of the container main assembly 2, on the right side of the developer outlet 2*a*, their left side is where the developer outlet 2*a* is. Thus, they are tilted so that their left side will be on the trailing side with respect to the direction in which the container main assembly is orbitally moved. In FIG. 4, the orbital direction is downward. Thus, the conveyance ribs on the right side of the developer outlet 2*a* are such ribs that are tilted so that their left end portions are raised relative to their right end portions, in the drawing. In comparison, in the case of the conveyance rib on the left side of the developer outlet 2*a*, its right side is where the developer outlet 2*a* is. Thus, the conveyance rib on the left side of the developer outlet 2*a* is such rib that is tilted so that its right end portion is raised relative to its left end portion, in the drawing.

Figure 10:
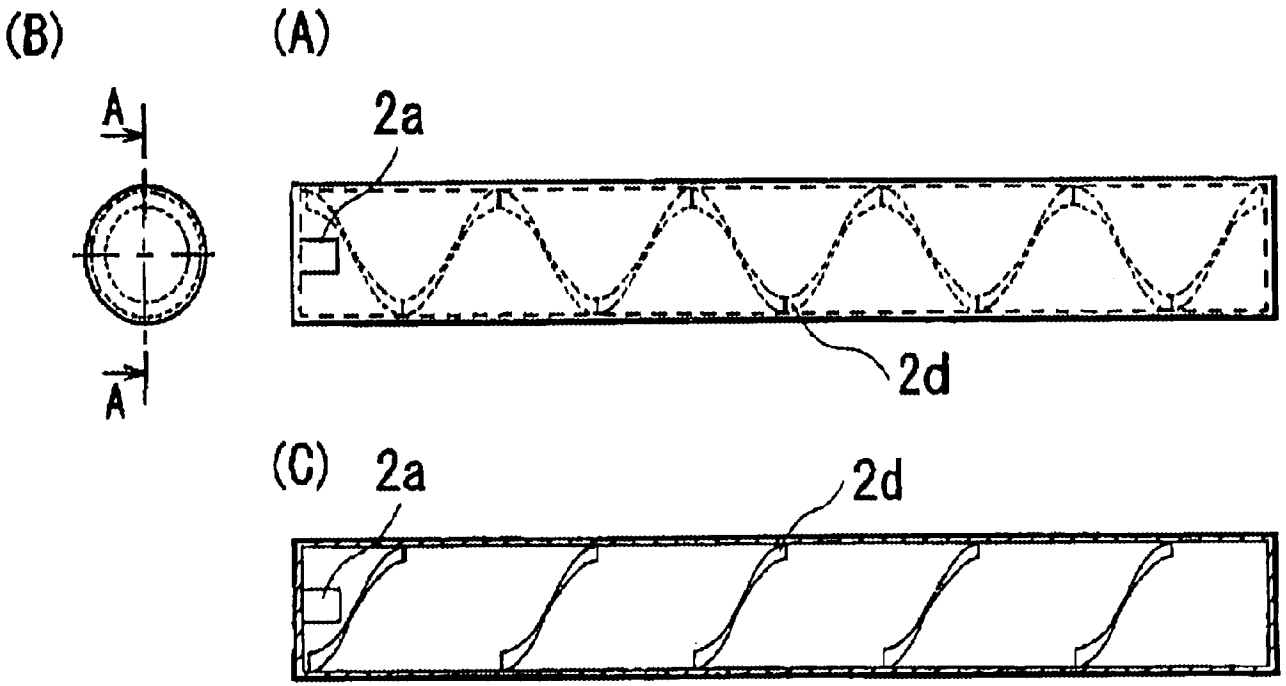
FIGS. 10(A), 10(B), and 10(C) are a front view of the cylindrical container with an internal diameter $\phi$ of 40 having an internal spiral rib, side view of the cylindrical container with an internal diameter $\phi$ of 40 having an internal spiral rib, and sectional view of the cylindrical container with an internal diameter $\phi$ of 40 having an internal spiral rib, respectively.

Each of the conveyance ribs in the top and bottom members 2-1 and 2-2 of the container main assembly 2 is in the form of a piece of flat plate. In other words, it has such a shape that appears like a straight line, as seen the from the removal direction of the metallic molds during the molding of the top and bottom members 2-1 and 2-2. In the case of a container having an internal spiral rib, each of the conveyance ribs in the top and bottom members 2-1 and 2-2 of the container main assembly 2 is in the form of a piece of twisted plate, regardless of the angle of the sectional view, as shown in FIG. 10.

Referring to FIG. 4, the positional relationship between the set of conveyance ribs 2*d* in the top member 2-1 of the container main assembly 2, and the set of conveyance ribs 2*d* in the bottom member 2-2 of the container main assembly 2, is as shown in the drawing. In other words, in terms of the axial direction of the rotary type developing apparatus, the conveyance ribs 2*d* in the top members 2-1 of the container main assembly 2 and the conveyance ribs 2*d* in the bottom member 2-2 of the container main assembly 2 are alternately positioned, whereas in terms of the direction perpendicular to the axial direction of the rotary type developing apparatus, the conveyance rib 2*d* and conveyance rib 2*d* partially overlap by their lengthwise end portions. The amount of the overlap (measurement of X in drawing), which here is measured as the length of the projected image of any of the overlapping portions of the conveyance rib 2*d* and conveyance rib 2*d*, is roughly 5 mm. Therefore, it is assured that after being conveyed a certain distance by the conveyance ribs 2*d* of the top member 2-1, the developer particles are further conveyed by the conveyance ribs 2*d* of the bottom member 2-2, and then, after being conveyed a certain distance by the conveyance ribs 2*d* of the bottom member 2-2, they are further conveyed by the conveyance ribs 2*d* of the top member 2-1. In other words, the developer particles are conveyed toward the developer outlet through the alternate repetition of the above described conveyance processes. Thus, the phenomenon that a certain amount of the developer fails to be conveyed by falling off through the gap between the adjacent two conveyance ribs is prevented. Therefore, the developer is conveyed at a higher speed and is discharged at a higher speed.

Referring to FIG. 4, the angle Y of the conveyance ribs 2*d* relative to the rotational axis of the rotary type developing apparatus is desired to be in a range of 20°–70°, preferably, in a range of 40°–50°. In this embodiment, it is 45°.

If the angle Y of the conveyance ribs 2*d* is no more than 20°, it is difficult for the developer particles to slide down on the conveyance ribs 2*d*, and therefore, the developer conveyance speed is lower, whereas if it is no less than 70°, it is necessary to increase the number of the conveyance ribs 2*d*, reducing thereby the internal space of the container main assembly 2.

Therefore, the angle Y of the conveyances rib 2*d* is made to be within the aforementioned range, so that the developer is conveyed at a preferable rate.

Further, referring to FIG. 5, regarding the bottom member 2-2 of the container main assembly, the first and second conveyance ribs 2*d*-2, counting from one end of the bottom member 2-2 of the container main assembly, where the developer outlet 2*a* is located, are disposed in a manner to sandwich the developer outlet 2*a*. Therefore, after being conveyed to the adjacencies of the developer outlet 2*a*, some of the developer particles in a given portion of the body of developer in the container main assembly are immediately discharged from the developer outlet 2*a* as the developer supply container is orbitally moved. The remaining portion of the given portion of the body of the developer remains in the range in which the developer outlet 2*a* is, and is further conveyed while being stirred. In other words, with the provision of this structural arrangement, it is possible to better stir the developer, making therefore it possible to more smoothly discharging the developer from the developer outlet 2*a*, without increasing the length of the container main assembly.

(Manufacturing Method for Container Main Assembly)

A developer supply container can be manufactured by welding or gluing two or more parts formed by an injection molding method, an extrusion molding method, a blow molding method, etc. In this embodiment, the top and bottom members 2-1 and 2-2, shown in FIG. 5, are separately molded by an injection molding method, and are welded into the developer supply container main assembly 2, with the use of an ultrasonic welding machine. The direction in which the metallic molds are removed during the molding of the top and bottom members 2-1 and 2-2 of the container main assembly is indicated by an arrow mark in the drawing.

The employment of the above described manufacturing method makes it possible to manufacture a developer supply container without wasting resin. Although, in this embodiment, shock resistant polystyrene was used as the material for the developer supply container 1, other substances may be used (Shutter)

Referring to FIG. 2, the shutter 3 is in the form of a piece of arcuate plate, the curvature of which matches the curvature of the peripheral surface of the contain main assembly 2, and the two opposing edges of which are bent in the form of a letter U, constituting guiding portions, whereas the container main assembly 2 is provided with a pair of parallel shutter guides 2*b*, which extend on the external surface of the container main assembly 2, in the direction perpendicular to the lengthwise direction of the container main assembly 2, in a manner to sandwich the developer outlet. The shutter 3 is attached to the container main assembly 2 by moving the shutter 3 so that the pair of parallel shutter guides 2*b* slide into the U-shaped grooves of the shutter 3, one for one, allowing the shutter 3 to be moved in the direction perpendicular to the lengthwise direction of the container main assembly 2, following the curvature of the peripheral surface of the container main assembly 2.

Between the shutter 3 and container main assembly 2, a sealing member 4 is disposed, hermetically sealing the developer outlet 2*a* by remaining compressed by the shutter 3.

(Manufacturing Method for Shutter)

The shutter 3 is desired to be formed of plastic with the use of an injection molding method. However, other materials and other methods may be used. As the material for the shutter 3, a substance, the rigidity of which is greater than a certain level, is preferable. In this embodiment, it is manufactured using the combination of highly slippery ABS resin and an ejection molding method.

(Sealing Member)

Referring to FIG. 2, the sealing member 4 is disposed in a manner to surround the developer outlet 2*a* of the container main assembly 2, and seals the developer outlet 2*a* by being compressed against the container main assembly 2 by the shutter 3. As the material for the sealing member 4, one of various well-known foamed substances or elastic substances can be used. In this embodiment, foamed polyurethane is used.

(Knob)

Also referring to FIG. 2, a knob 5 comprises a knob proper portion and a double-walled cylindrical portion. A part of the external surface of the external wall of the double-walled cylindrical portion is shaped in the form of a gear, and a part of the internal surface of the internal wall of the double-walled cylindrical portion is provided with a claw, which engages with a cylindrical projection (rib) on the end portion of the container main assembly 2. This claw is used to attach the knob 5 to the front end portion of the container main assembly 2 so that the knob proper portion can be rotated about the axial line of the double-walled cylindrical portion, along with the cylindrical portion. In this embodiment, the knob 5 is also manufactured with the use of the combination of shock resistant polystyrene and an injection molding method.

(Mounting of Developer Supply Container into Image Forming Apparatus)

Next, how the developer supply container 1 is mounted into an image forming apparatus, and the state of the developer supply container 1 in operation, will be described.

Figure 6:
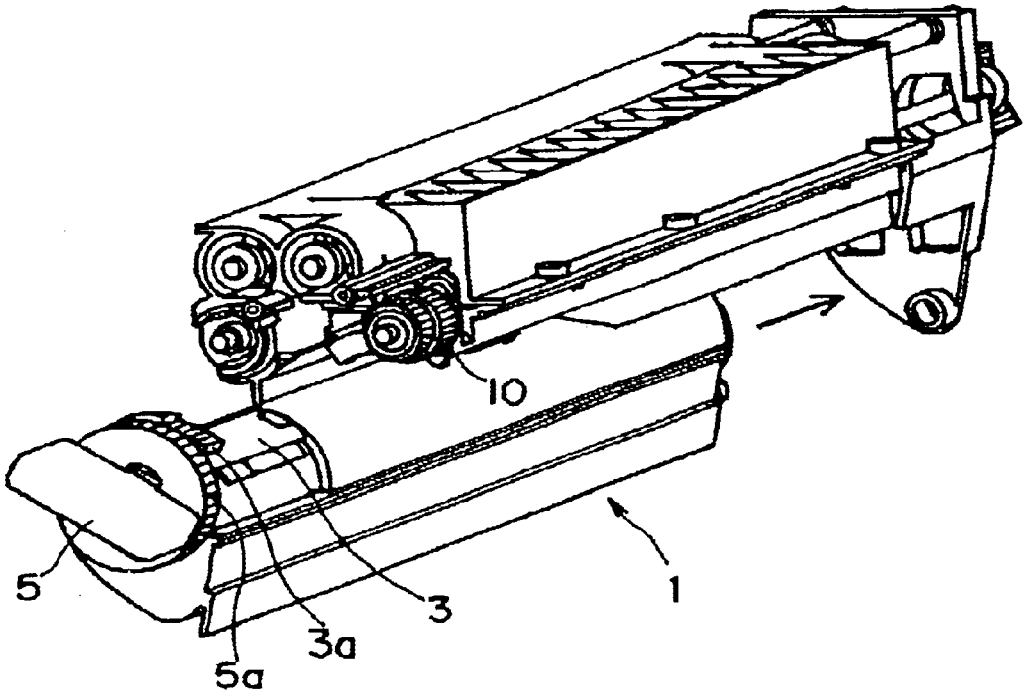
FIG. 6 is a drawing for describing how the developer supply container is mounted.

Referring to FIG. 6, how the developing supply container 1 is mounted will be described. First, the developer supply container 1 is inserted into the rotary type developing device of the image forming apparatus main assembly, with the developer supply container 1 positioned so that the knob 5 is on the front side (developer outlet is on front side). As the developer supply container 1 is inserted, the knob gear 5*a* meshes with the gear 10 on the developing device side, and the gear 10 on the developing device side meshes with the shutter gear 3*a*. Further, the shutter 3 is fitted into the shutter 11 (unshown in FIG. 6) on the developing device side.

Figure 7:
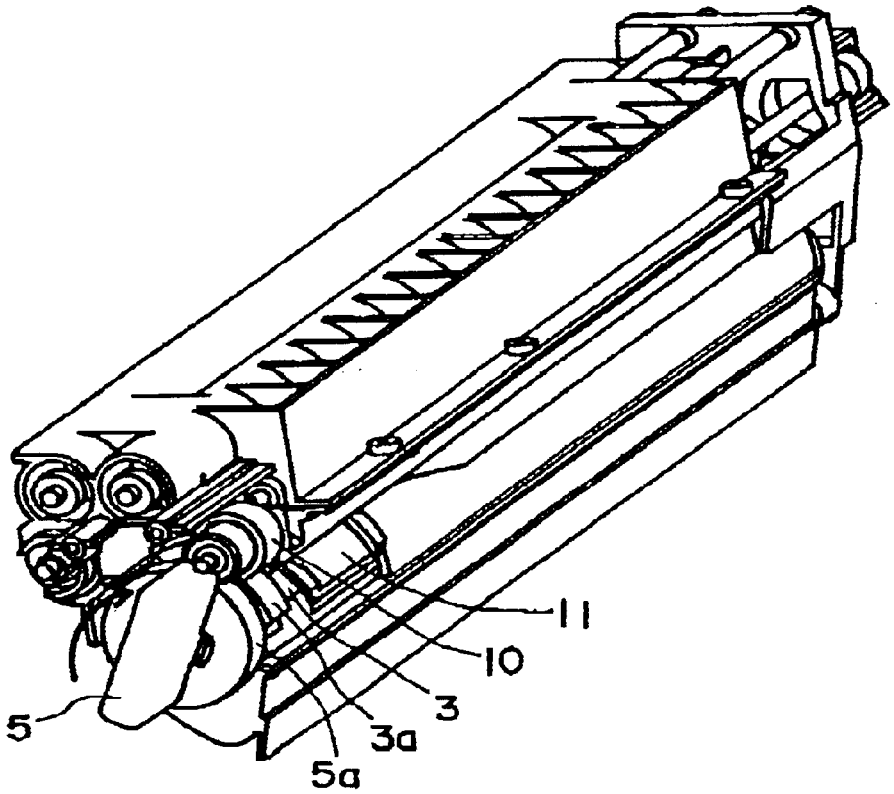
FIG. 7 is a drawing for describing how the developer outlet is opened.

Next, referring to FIG. 7, the movement of the shutter 3 during the unsealing of the developer supply container 1 will be described. First, the container main assembly is to be rotated a predetermined angle in the direction indicated by an arrow mark, by grasping the knob proper portion of the knob 5 on the front end portion of the container main assembly. As the container main assembly is rotated, rotational force is transmitted to the gear 3*a* of the shutter 3 from the gear 5*a* of the knob 5 through the gear 10 on the apparatus main assembly side. As a result, the shutter 3 is rotated along with the shutter on the developing device side. As the two shutters are rotated, the hole (unshown) of the shutter on the developing device side becomes connected to the developer outlet 2*a* of the developer supply container 1; the developer outlet 2 is opened.

The positioning of the developer supply container 1 during the mounting of the developer supply container 1 into an image forming apparatus, and the method for mounting it into an image forming apparatus, are not limited to the above described ones. In other words, the optimal position and method may be chosen in consideration of the structure of the main assembly of the image forming apparatus.

The developer supply container 1 is mounted into the rotary type developing apparatus in such a manner that it does not rotates about its axial line, and that it is orbitally moved about the axial line of the rotary type developing apparatus by the rotation of the rotary type developing apparatus. Thus, it is unnecessary to provide the container main assembly with a structure for receiving the force for rotational driving of the container main assembly. Therefore, not only is the developer supply container lower in cost, but also, it is capable of contributing to the cost reduction of the image forming apparatus main assembly.

(Operation of Developer Supply Container)

Figure 8:
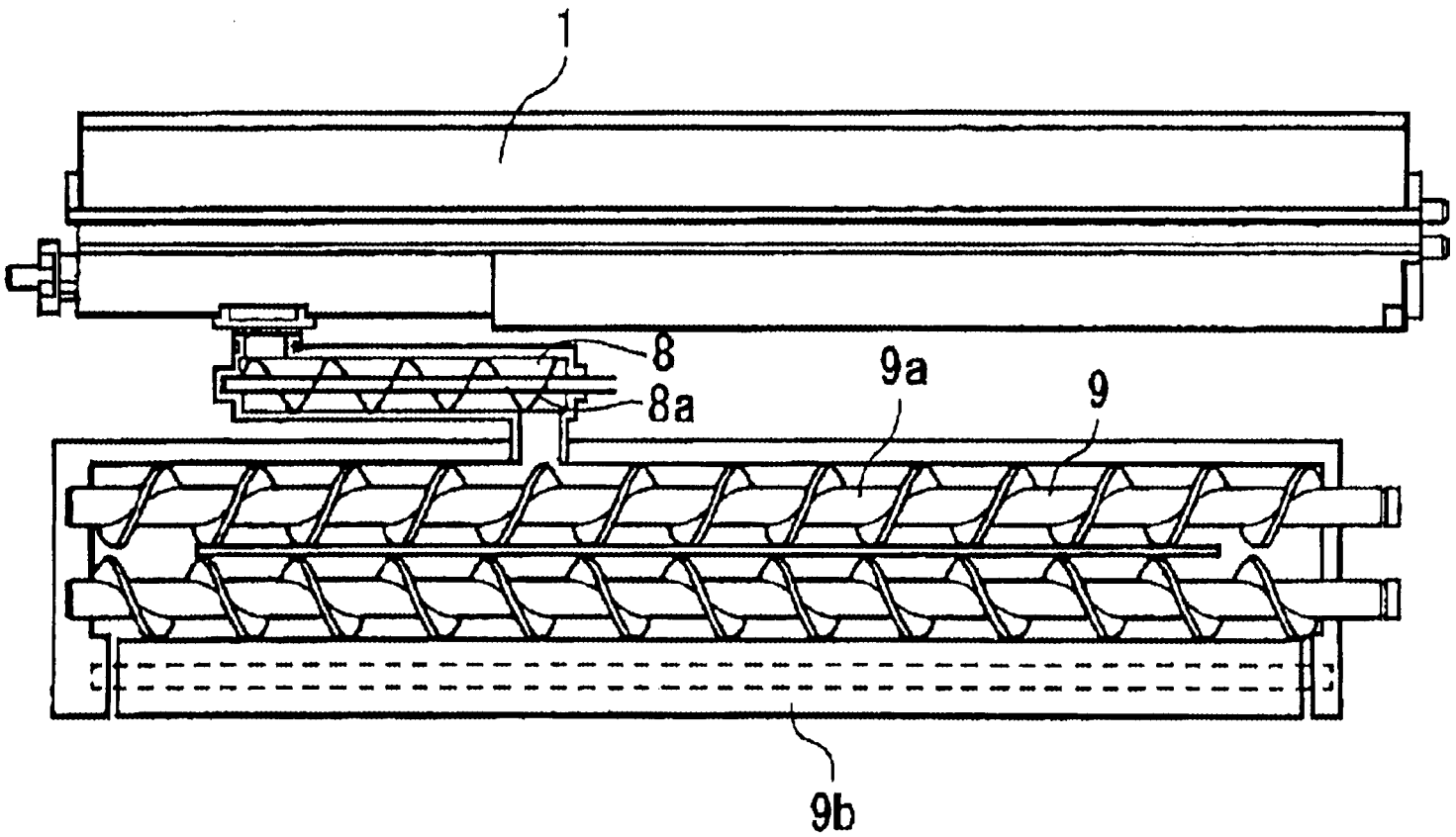
FIG. 8 is a sectional view of the developing device, at a plane perpendicular to the lengthwise direction of the developing device.

Next, referring to FIG. 8, the operation of the developer supply container 1 in this embodiment in the rotary type developing apparatus 30 will be described.

The container main assembly 2 is filled with a predetermined amount of developer. Then, it is mounted into the rotary type developing device, following the above described steps, and then, is unsealed.

While images are formed, the developer in the developing device 9 is gradually consumed. Meanwhile, the developer conveying member 8*a* in the developer inlet portion 8 is rotated for a predetermined length of time, in response to the signals from the means for detecting the amount of the developer in the developing device 9 and the ratio between the developer and carrier in the developer device 9, so that the developer is sent into the developing device 9 in order to keep roughly constant the ratio between the developer and carrier in the developing device 9.

Figure 9:
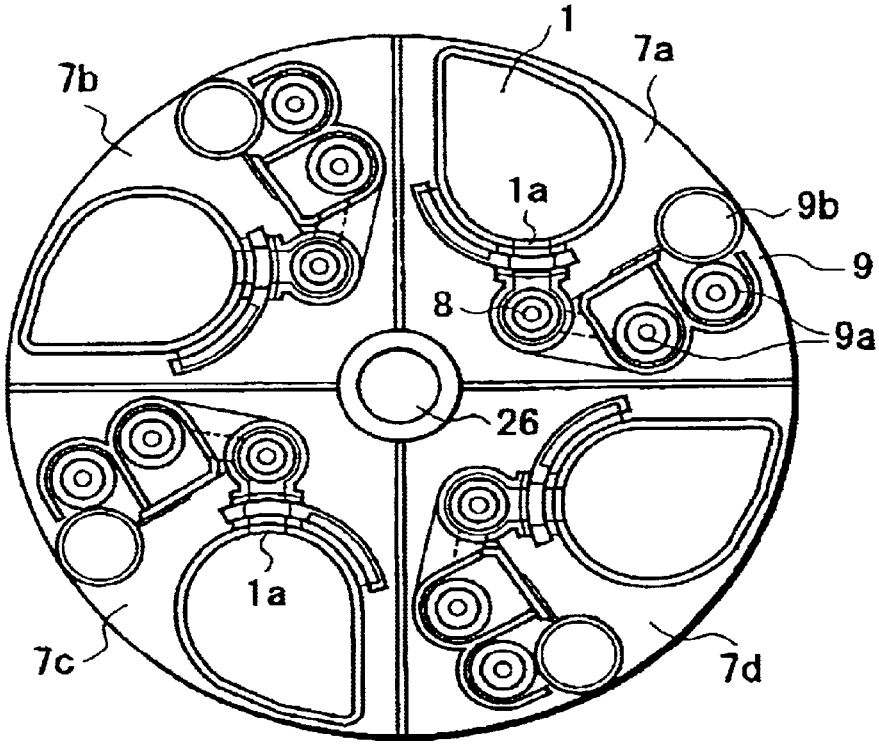
FIG. 9 is a front view of the rotary type developing apparatus, the internal space of which is divided in four sections.

Referring to FIG. 9, the structure and operation of the rotary type developing apparatus 30 will be described. The rotary type developing apparatus shown in FIG. 9 is roughly cylindrical. The internal space of the rotary type developing apparatus is divided into four sections for holding four color developing devices 9 (Y, M, C, and Bk), and four developer supply containers 1 corresponding thereto, one for one.

In the drawing, this rotary type developing apparatus rotates in the counterclockwise direction, and each rotational movement is limited to 90° so that as it stops, the designated developing device 9 is positioned to oppose the photoconductive drum. In this embodiment, the designated developing device 9 opposes the photoconductive drum at the location 7*a*, which hereinafter will be referred to as development station. The developer conveying member 9*a* and development sleeve 9*b* of each developing device 9 can be driven only when the developing device 9 is at the development station 7*a*; the driving force from the image forming apparatus main assembly is transmitted to the developing device 9 only when the developing device 9 is at the development station 7*a*. In other words, the developing devices 9 and developer inlet portions 8 which are at the locations 7*b* 7*c*, and 7*d*, that is, the locations other the development station 7*a*, do not operate.

The developer supply container may be mounted or removed at any of these four locations. However, the locations other than the development station 7*a* are preferable. It is best for the developer supply container to be mounted or removed at the location 7*c* at which the opening of the developer outlet 2*a* faces upward. In this embodiment, therefore, the developer supply container is mounted or removed at the location 7*c*.

Next, referring to FIG. 8, the state of the developer in the developing device at the development station 7*a* will be described.

The developing device 9 and developer inlet portion 8 operate at the development station 7*a*. As they operate, the amount of the developer in the developer inlet portion 8 reduces, in particular, from the upstream side, that is, the adjacencies of the joint between the developer outlet 2*a* of the developer supply container 1 and the developer inlet portion 8.

The developer supply container 1 is structured so that it will remain directly above the developer inlet portion 8. Therefore, as the amount of the developer in the developer inlet portion 8 reduces, the portion of the developer in the end portion of the developer supply container 1 falls, due to its own weight, through the developer outlet 2*a*, into the developer inlet portion 8.

In other words, when a given developing device is at the location 7*a*, that is, the location at which the developing device performs the development process, the opening of the developer outlet 2*a* of the developer supply container 1 mated to this developing device faces roughly downward, that is, the gravity direction. Therefore, the developer is naturally discharged (falls); as the developing device is moved to the development location at which the developer is consumed, the developer is efficiently supplied to the developer.

Even if there is not enough amount of the developer in the end portion of the developer supply container 1, the developer in the other parts of the developer supply container 1 is conveyed to the end portion of the developer supply container 1 by the conveyance ribs 2*d* while the rotary type developing apparatus rotates once. Thus, by the time the developing device returns to the development station 7*a*, the developer inlet portion 8 is supplied with the developer.

The position of the developer outlet of the developer supply container 1 relative to the developer inlet portion 8*a* when the developer supply container 1 is at the development station 7*a* is optional. However, the developer outlet is desired to be diagonally above, preferably, directly above, the developer inlet portion 8*a* when the developer supply container 1 is at the development location 7*a*. Even the structural arrangement is such that at the development location 7*a*, the developer is not allowed to naturally fall from the developer supply container 1 into the developer inlet portion 8, there is a time when the developer supply container 1 is positioned above the developer inlet portion 8 each time the rotary type developing apparatus rotates. Therefore, it is assured that the developing device is supplied with the developer.

After the formation of two A4 copies or one A3 copy, this rotary type developing apparatus is rotated 90° to switch developing devices. The time required for the switching is roughly 0.3 second, and the time during which the rotary type developing apparatus remains stationary for image formation is roughly 1.2 second. The peripheral velocity of the rotary type developing apparatus during its movement for developing device switch is approximately 0.7 m/second, and the diameter ϕ of the rotary type developing apparatus is 190 mm.

The diameter of the rotary type developing apparatus means the maximum diameter of the rotary type developing apparatus, that is, the diameter of the rotary type developing apparatus when the developing apparatus is holding all the developer supply containers it is capable of holding. Thus, the distance from the rotational axis of the rotary type developing apparatus to the outermost peripheral point of a given developing device on the rotary type developing apparatus, that is, the maximum radius of the rotary type developing apparatus constitutes the radius of the orbit of the given developing device, and the speed of this outermost peripheral point of the given developing device constitutes the peripheral velocity of the rotary type developing apparatus.

The internal space of the rotary type developing apparatus in this embodiment is divided into four sub-spaces of an equal size, into which four developing devices 9Bk, 9Y, 9M, and 9C, different in the color of the developer therein, are mounted one for one. However, the internal space may be divided into sub-spaces different in size in order to accommodate developing devices different in size, so that a developer supply container, for example, the developer supply container 1Bk for the black developer, the developer in which is higher in usage frequency, can be increased in internal volume relative to the rest of the developer supply container (color developer supply containers). This type of structural arrangement is also compatible with the present invention, and brings forth the similar effects as those described above.

The developer stored in the developer supply container in this embodiment may be any of the followings: single component developer, two-component developer, two-component carrier, mixture of two-component toner and two-component carrier, etc.

(Tests)

The spiral rib in accordance with the prior art, and the conveyance rib in accordance with the present invention, were tested to compare them in terms of developer discharge performance. A developer supply container, such as the one in the first embodiment, the cross section of which is noncircular, cannot be provided with a spiral rib. Therefore, tests were carried out using cylindrical developer supply containers, which were ϕ 40 in internal diameter, and 350 mm in length (roughly 430 cc).

FIG. 10 shows the container having an internal spiral rib, which was used in these tests. FIGS. 10(A), 10(B), and 10(C) are front view, side view, and sectional view at plane A—A in FIG. 10(B).

Figure 11:
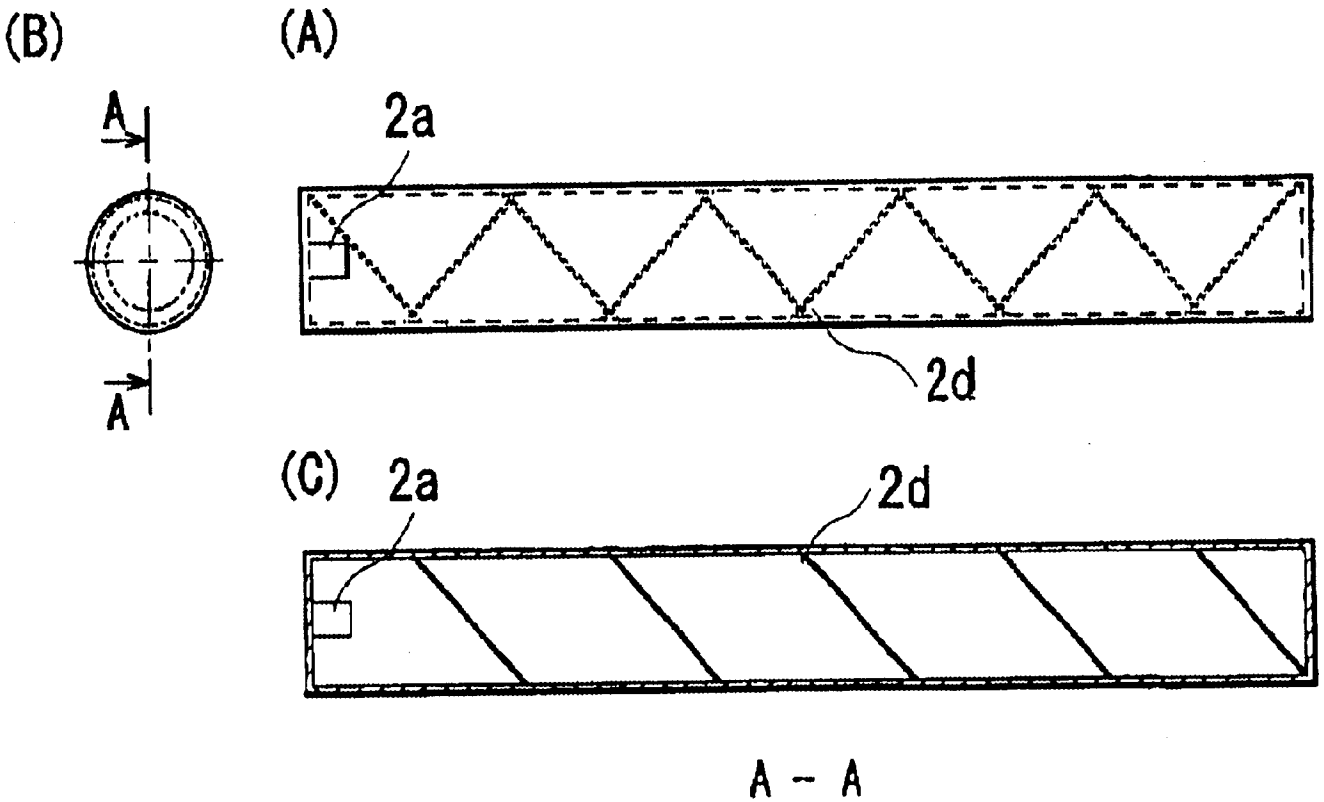
FIGS. 11(A), 11(B), and 11(C) are a front view of the cylindrical container with an internal diameter $\phi$ of 40 having internal conveyance ribs in accordance with the present invention, side view of the cylindrical container with an internal diameter $\phi$ of 40 having internal conveyance ribs in accordance with the present invention, and sectional view of the cylindrical container with an internal diameter $\phi$ of 40 having internal conveyance ribs in accordance with the present invention, respectively.

Shown in FIG. 11 is the container having the internal conveyance rib in accordance with the present invention. FIGS. 11(A), 11(B), and 11(C) are front view, side view, and sectional view at plane A—A in FIG. 11(B).

The height and pitch of the spiral rib of the developer supply container in FIG. 10 were 5 mm and 71 mm. The number of turns of this spiral rib was 5.

In comparison, the height of the conveyance ribs in the developer supply container in FIG. 11 was 5 mm, and each of the top and bottom members of the container is provided with five conveyance ribs. The amount of the overlap between the set of conveyance ribs of the top member of the container and the set of conveyance ribs of the bottom member of the container was 5 mm.

These developer supply containers each were filled with 180 g of the developer, and were tested for developer discharge performance, with the use of a jig, a simplified form of the rotary type developing apparatus, (created by removing developing devices from rotary type developing apparatus so that amount of developer discharged from developer outlet of each developer supply container can be directly measured). The incremental rotational angle of the jig was set to 90° (90°×4; 90°→90°→90°→90°). Its moving time per 90° C. was set to roughly 0.3 second, and the time during which the jig was kept stationary for image formation was set to roughly 1.2 second. The peripheral velocity of the jig during its movement for developing device switch was set to approximately 0.7 m/second, and the diameter ϕ of the jig was 190 mm.

(Results)

As for the amount of the developer remaining in the developer supply container after the effective developer depletion from the developer supply container (discharging of developer was stopped when amount of developer discharged per incremental rotation of developing apparatus fell below 0.1 g), it was 0.9 g for the developer supply container with the spiral rib, whereas it was 1.1 g for the developer supply container, which had the conveyance ribs in accordance with the present invention. In other words, there was virtually no difference between the two developer supply containers. However, the total number of rotations the container with the spiral rib required to be depleted of the developer therein was roughly 110 times, whereas that for the developer supply container with the conveyance ribs in accordance with the present invention was roughly 60 times.

Figure 14:
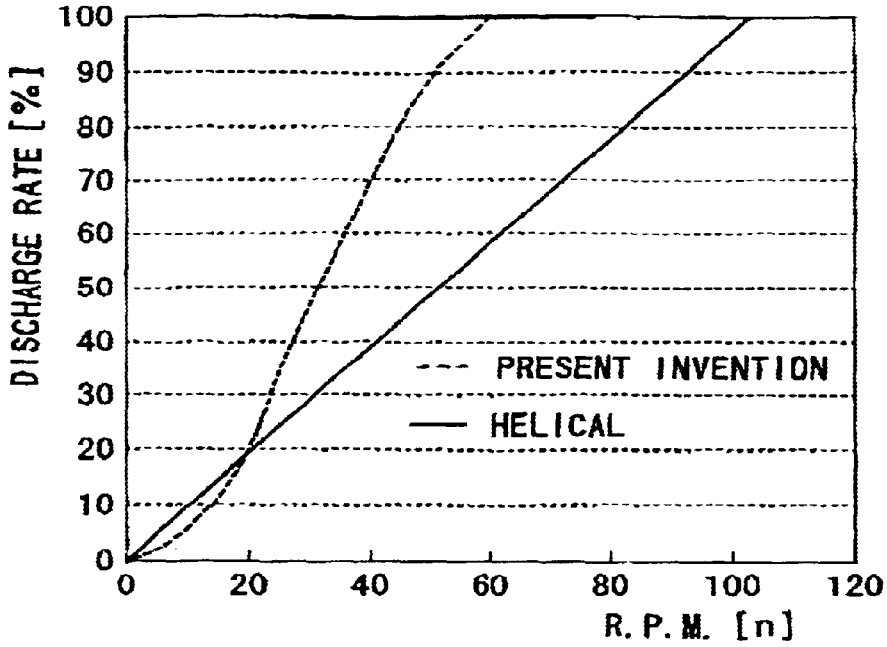
FIG. 14 is a graph showing the cumulative amounts of the developer discharged from the container with the ordinary internal spiral rib and the container with the internal conveyance ribs in accordance with the present invention.

The results of this test were given in the form of a graph, in FIG. 14. The solid line represents the cumulative ratio of the developer discharged from the developer supply container with the spiral rib, and the dotted line represents the cumulative ratio of the developer discharged from the developer supply container with the conveyance ribs in accordance with the present invention.

(Analysis)

As described above, the developer supply container having the conveyance ribs in accordance with the present invention was faster in the developer discharge speed than the developer supply container having the spiral rib in accordance with the prior art.

Figure 12:
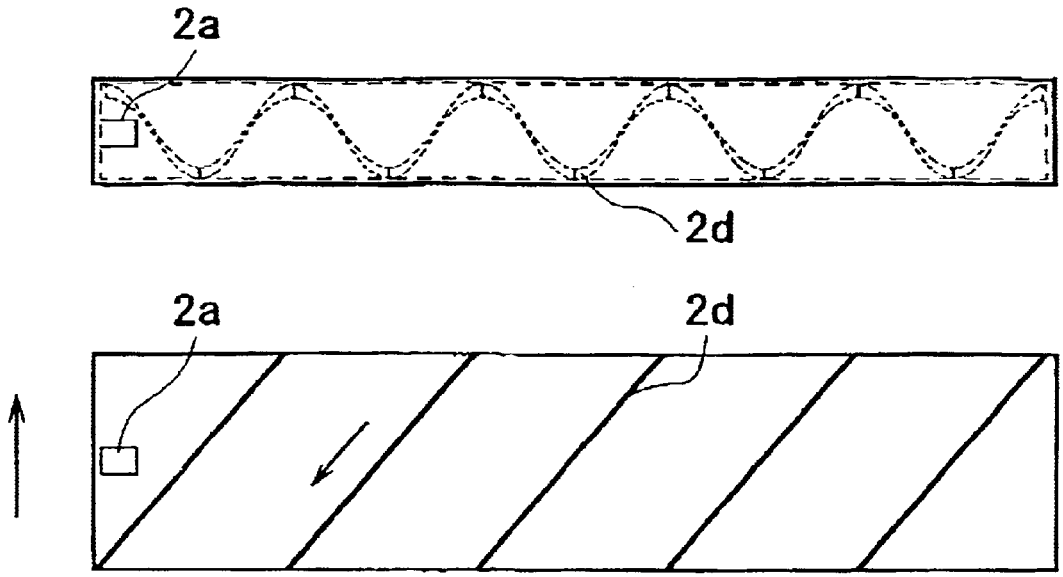
FIG. 12 is a development of the cylindrical container with an internal diameter $\phi$ of 40 having internal spiral ribs.

The reasons for the above results will be addressed based on the shapes of the spiral rib and conveyance ribs. FIG. 12 is a development of the container provided with the spiral rib, and FIG. 12 is a development of the container provided with the conveyance ribs in accordance with the present invention.

Referring to FIG. 12, in the case of the container with the spiral rib, its spiral rib is configured so that the developer therein is conveyed only in one direction, and that the amount of the force the developer in the container receives each time the rotary type developing apparatus is rotated is constant. Therefore, the layer of the powdery developer is conveyed at a constant speed while retaining its shape. As a result, the developer layer tends to partially, or sometimes fully, blocks the developer outlet, reducing thereby the developer discharge velocity.

Figure 13:
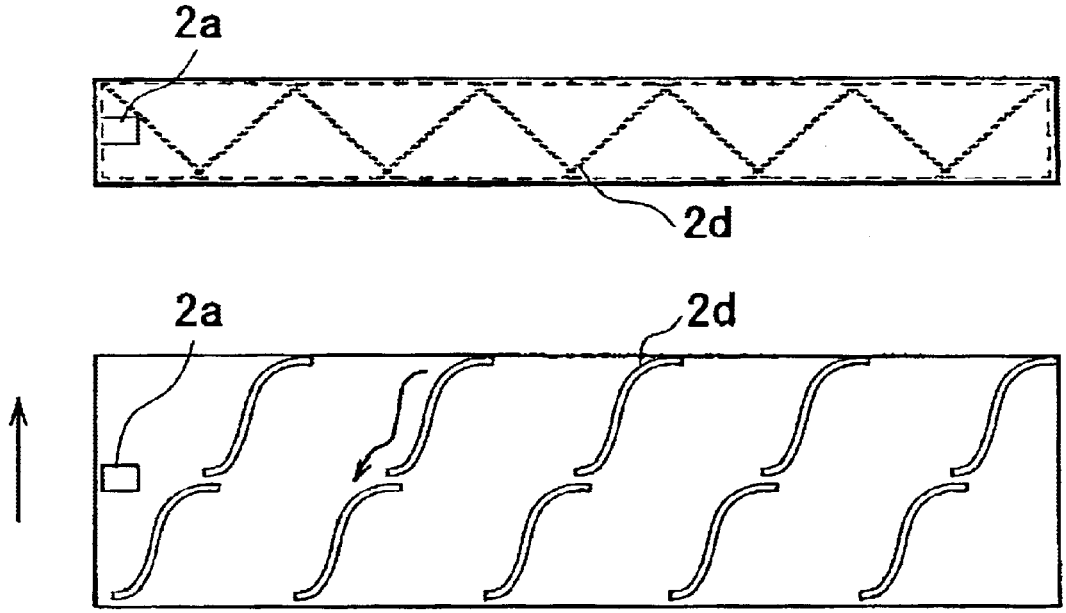
FIG. 13 is a development of the cylindrical container with an internal diameter $\phi$ of 40 having internal conveyance ribs in accordance with the present invention.

In comparison, the conveyance ribs in accordance with the present invention are arcuately bent, and each conveyance rib of the top member of the container main assembly overlaps with the corresponding conveyance rib of the bottom member of the container main assembly, as shown in FIG. 13. Thus, as this developer supply container is orbitally moved by the rotation of the rotary type developing apparatus, the developer is conveyed in various directions by these conveyance ribs, because the direction of the force the developer receives from each conveyance rib varies depending on with what part of the conveyance rib the developer comes into contact. As a result, while the layer of the powdery developer is conveyed and guided by each conveyance rib, it is repeatedly subjected to a combination of a compression process (by gently angled surfaces), a expansion process (by sharply angled surfaces), and a compression process (by gently angled surfaces). This phenomenon that the developer layer becomes fluid by being fluffed up by the conveyance rib also occurs at other conveyance ribs. Therefore, by the time a given portion of the body of the developer arrives at the developer outlet to be discharged, it will have been well fluidized.

Further, as the developer supply container is orbitally moved by the rotation of the rotary type developing apparatus, the distance between the aforementioned two sets of conveyance ribs, that is, the set of conveyance ribs in the top member of the container main assembly and the set of conveyance ribs in the bottom member of the container main assembly, repeatedly turns vertical, causing the given portion of the body of the developer to fall through the air. As a result, the given portion of the developer is fluffed up by the air; it is fluidized. Thus, the given portion of the developer does not block the developer outlet, being therefore smoothly discharged therefrom; it is discharged at a higher speed.

It is evident from FIG. 14 that the rate at which the developer is discharged from the developer supply container having the spiral rib is constant, and also that the developer supply container having the conveyance ribs in accordance with the present invention is greater in the amount by which the developer is discharged per rotation of the rotary of the rotary type developing apparatus. It is thought by the inventors of the prevent invention that this confirms the effects of the configuration of the conveyance ribs, and the stirring effect of the distance, in terms of the circumferential direction of the container, between a given conveyance rib in the top member of the container main assembly, and the corresponding conveyance rib in the bottom member of the container main assembly.

As described above, according to this embodiment of the present invention, the developer is conveyed, while being stirred, to the developer outlet, by the functions of the plurality of parallel conveyance ribs 2*d* grouped in two sets, as described above, in which the parallel conveyance ribs 2*d* are tilted relative to the rotational axis of the rotary type developing apparatus, and also overlap in the developer conveyance direction. Therefore, even after the developer in the developer supply container agglomerates and/or becomes compacted in the developer supply container due to the vibrations during the shipment of the developer supply container and/or because the developer supply container is stored unattended under harsh conditions, the developer can be smoothly discharged through the developer outlet.

Further, the developer supply container can be manufactured (molded) using an injection molding method, without increase in material cost and reduction in the internal volume of the container main assembly, making it easier to find and choose flame resistant substances suitable as the material for the developer supply container.

(Embodiment 2)

Next, the developer supply container in the second embodiment of the present invention will be described with reference to FIGS. 15, 16, and 17. The general structure of the electrophotographic copying machine as an example of an electro-photographic image forming apparatus in which the developer supply container is mounted, is virtually the same as that in the first embodiment described above with reference to FIG. 1. Therefore, the members in this embodiment, which are the same in functions as those in the first embodiment, will be given the same referential signs as those given in the first embodiment, and only the differences between the developer supply container in this embodiment and that in the first embodiment will be described.

Figure 15:
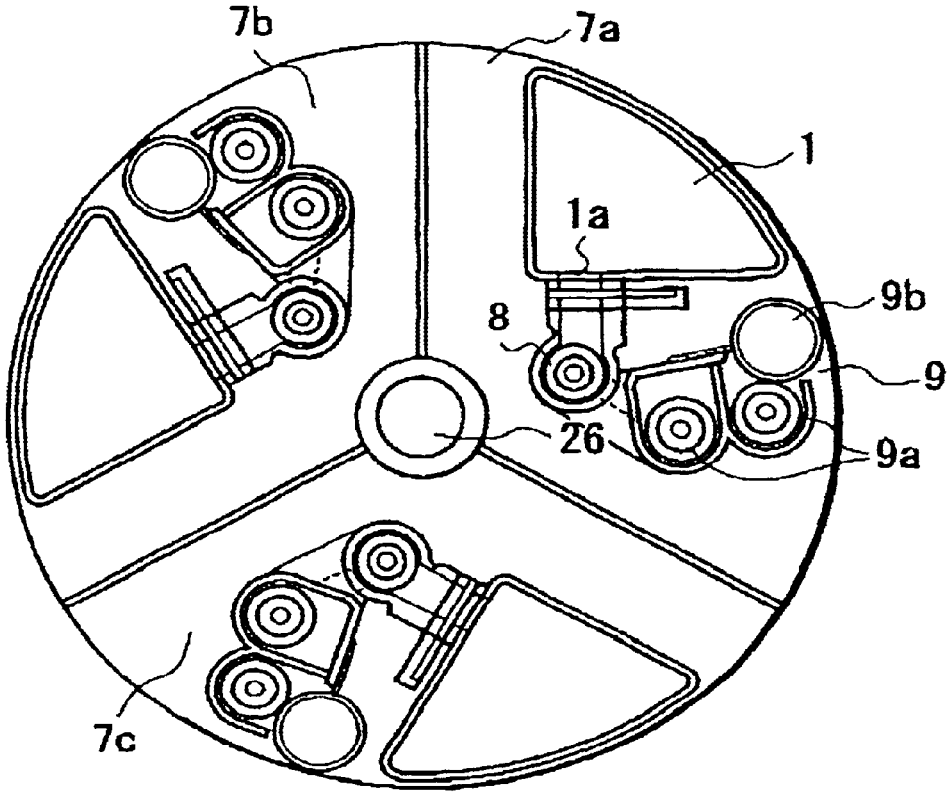
FIG. 15 is a front view of the rotary type developing apparatus, the internal space of which is divided in three sections.

The developer supply container in this second embodiment of the present invention shown in FIG. 15 is a developer supply container compatible with a rotary type developing apparatus, the interior of which is divided into three equal sections.

Figure 16:
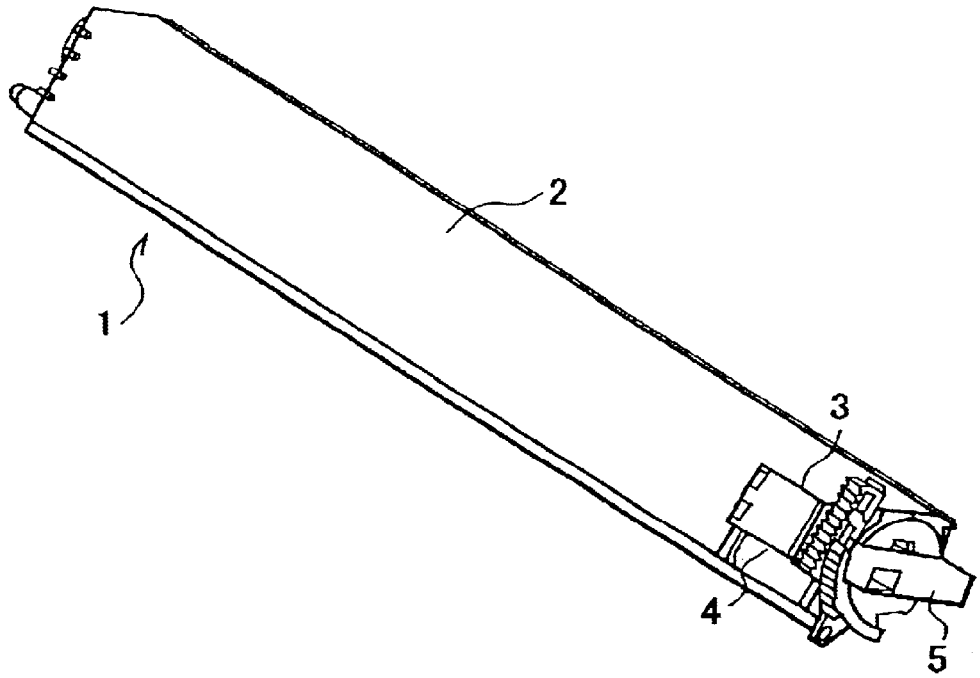
FIG. 16 is a perspective view of the developer supply container in the second embodiment of the present invention.
Figure 17:
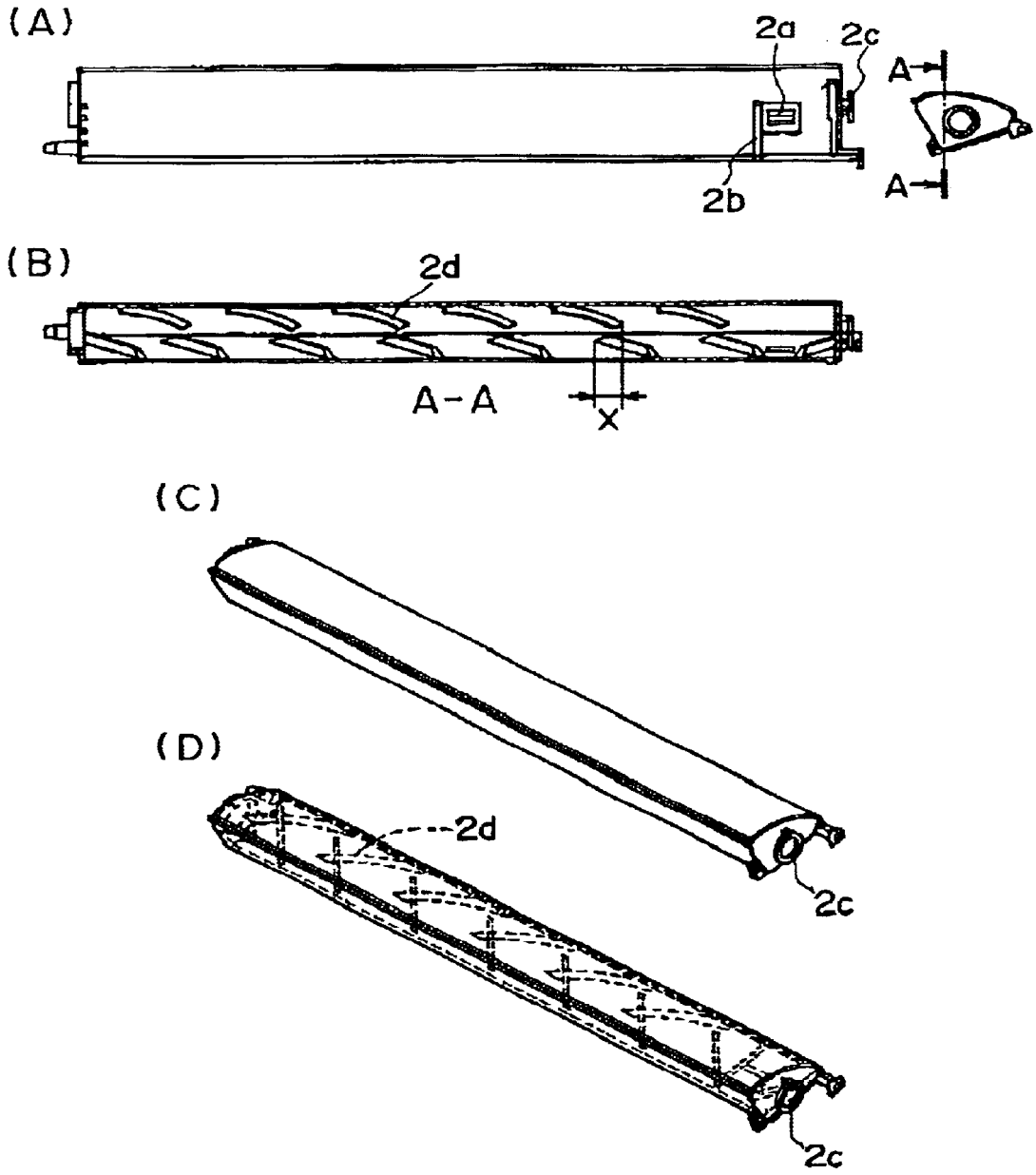
FIGS. 17(A), 17(B), 17(C), and 17(D) are a front view, sectional view parallel to the end panels thereof, perspective view, and perspective phantom view, of the main assembly of the developer supply container, respectively.

FIG. 16 is a perspective view of the developer supply container in the second embodiment of the present invention. FIGS. 17(A), 17(B), 17(C), and 17(D) are front view, sectional view at Plane A-A in FIG. 17(A), perspective view, and perspective phantom view, of the developer supply container in the second embodiment of the present invention.

First, referring to FIGS. 16 and 17, the developer supply container will be described. The developer supply container in the second embodiment also comprises a container main assembly 2, a shutter 3, a sealing member 4, and a knob 5 as does the developer supply container in the first embodiment. However, the container main assembly 2 in this embodiment is shaped so that its cross section becomes roughly triangular.

(Developer Outlet)

The opening of the developer outlet 2*a* is rectangular, and its size is 10 mm×15 mm. It is in the peripheral wall of the container main assembly 2, being positioned 24 mm inward of one of the end walls, in terms of the lengthwise direction of the container main assembly 2. The developer in the container main assembly 2 is discharged through the developer outlet 2*a* into the corresponding developing device of the main assembly of an image forming apparatus.

(Shutter Guides)

The shutter guides 2*b* are disposed next to the developer outlet 2*a* of the container main assembly 2, and are a pair of parallel ribs shaped so that their cross sections look like a key. The shutter 3 is engaged with these shutter guides 2*b* so that it can be moved back and forth along the flat surface of the container main assembly 2.

(Knob Guide)

The knob guide 2*c* is a disk-like rib, and is located at one of the lengthwise end portions of the container main assembly 2. The knob 5 is attached to the container main assembly 2 by engaging the claw portion (unshown) of the knob 5 with the disk-like rib of the knob guide 2*c*.

(Particle Conveyance Ribs)

The container main assembly 2 has a plurality of conveyance ribs 2*d* for conveying the developer in the container main assembly 2 toward the developer outlet 2*a*. The conveyance ribs 2*d* are erected in parallel on the internal surface of the peripheral walls of the container main assembly 2. The height of each rib is 5 mm. As for the thickness of each rib, it is 1 mm at the top and 1.5 mm at the base, being therefore in the form of a parallelepiped.

The structures of the shutter 3, sealing member 4, and knob 5 are the same as those in the first embodiment, and therefore, will not be described here.

Next, referring to FIG. 17, the internal structure of the developer supply container in the second embodiment will be described. The top portion (top member) of this developer supply container is provided with 6 conveyance ribs 2*d*, and the bottom portion (bottom member) is provided with 8 conveyance ribs 2*d*. The amount of the overlap (X in drawing) between each conveyance rib of the top portion and the corresponding conveyance rib of the bottom portion is 20 mm. The angle (Y in FIG. 18) of each conveyance rib 2*d* is the same as that in the first embodiment, which is 45°.

Figure 18:
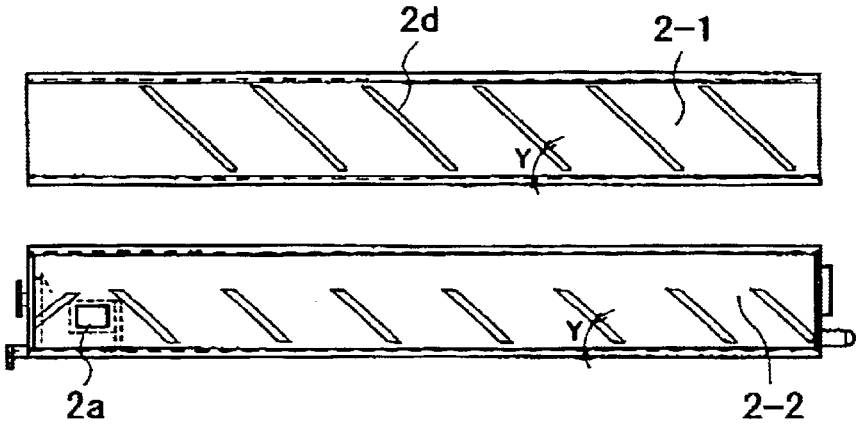
FIG. 18 is a drawing for describing the top and bottom members of the main assembly of the developer supply container, as seen from the direction in which metallic molds are removed.

FIG. 18 shows the top and bottom members 2-1 and 2-2 of the developer supply container, as seen from the direction in which the molds therefor are removed when molding the two members.

Each of the developer conveyance ribs in the top and bottom members of the container main assembly 2 is in the form of a piece of flat plate. In other words, it has such a shape that appears like a straight line, as seen the from the removal direction of the metallic molds during the molding of the top and bottom members 2-1 and 2-2. Incidentally, the base portion (portion next to internal surface of container) of the conveyance rib is made thicker for reinforcement.

(Method for Manufacturing Container Main Assembly)

A developer supply container can be manufactured by welding or gluing two or more parts formed by an injection molding method, an extrusion molding method, a blow molding method, etc. In this embodiment, the top and bottom members 2-1 and 2-2, shown in FIG. 18, are separately molded by an injection molding method, and are welded into the developer supply container main assembly 2, with the use of an ultrasonic welding machine.

The employment of the above described manufacturing method makes it possible to manufacture a developer supply container without wasting resin. Although, in this embodiment, shock resistant polystyrene was used as the material for the developer supply container 1, other substances may be used.

The state of the developer supply container 1 in an image forming apparatus, and the state of the developer supply container 1 being in operation in the rotary type developing apparatus 30, are the same as those in the above described first embodiment, and therefore, will not be described here.

Next, referring to FIG. 15, the structure and operation of the rotary type developing apparatus 30 will be described. The interior of the rotary type developing apparatus shown in FIG. 15 is divided into three equal portions, in which developing devices Y, M, and C different in the color of the developer they use, and developer supply containers corresponding thereto, are disposed one for one. In the case of this image forming apparatus, the developing device Bk (unshown) and correspondent developer supply container (unshown) are disposed independently from the rotary type developing apparatus.

This rotary type developing apparatus rotates in the counterclockwise direction, and each rotational movement is limited to 120° so that as it stops, the developing device 9 opposing the photoconductive drum can be removed. Also in the case of the rotary type developing apparatus shown in FIG. 15, as in the case of that in the first embodiment, the designated developing device 9 opposes the photoconductive drum at the location 7*a*, which hereinafter will be referred to as development station. The developer conveying member 9*a* and development sleeve 9*b* of each developing device 9 can be driven only when the developing device 9 is at the development station 7*a*; the driving force from the image forming apparatus main assembly is transmitted to the developing device 9 only when the developing device 9 is at the development station 7*a*. In other words, the developing devices 9 and developer inlet portions 8, which are at the locations 7*b* and 7*c*, that is, the locations other the development station 7*a*, do not operate.

The developer supply container may be mounted or removed at any of these three locations. However, the locations other than the development station 7*a* are preferable. In this embodiment, the developer supply container is mounted or removed at the location 7*c*.

After the formation of two A4 copies or one A3 copy, this rotary type developing apparatus is rotated 120° to switch developing devices. The time required for the switching is roughly 0.3 second, and the time during which the rotary type developing apparatus remains stationary for image formation is roughly 1.5 second. The peripheral velocity of the rotary type developing apparatus during its movement for developing device switch is approximately 0.8 m/second, and the diameter $\phi$ of the rotary type developing apparatus is 140 mm.

The above described second embodiment can offer the following effects, in addition to the various effects of the first embodiment.

First, in order to make it possible to supply, on demand, the black developer (Bk) used more frequently than the color developers, the developer supply container Bk for containing the black developer (Bk) can be disposed independently from the rotary 26 of the rotary type developing apparatus, and also, the developer supply container Bk can be provided with a driving means independent from the driving means for driving the rotary type developing apparatus. Therefore, the developing device for printing a monochromatic black copy can be supplied with developer, without rotating the rotary type developing apparatus. In addition, the developer capacity of the black developer supply container can be easily increased.

In the preceding embodiments, the number of the developing devices held by the rotary type developing apparatus was three or four. However, it does not need to be limited to three or four; it may be optimized as necessary.

The image forming apparatuses in the preceding embodiments were copying machines. The application of the present invention, however, is not limited to a copying machine. For example, the present invention is also applicable to such an image forming apparatus as a printer, a facsimileing machine, etc., other than a copying machine. Regarding an intermediary transferring means, the present invention is also applicable to an image forming apparatus which employs a transfer medium bearing member, for example, a transfer-conveyance belt, instead of a transfer drum, so that a plurality of toner images different in color are sequentially transferred in layers onto a transfer medium, for example, a piece of paper, on the transfer medium bearing member, or an image forming apparatus, which employs an intermediary transferring member, onto which a plurality of toner images different in color are sequentially transferred in layers, and from which the plurality of the layered toner images are transferred all at once onto a transfer medium. The application of the present invention to such image forming apparatuses offers the same effects as those described above.

As described above, according to the above described embodiments, the developer supply container can be manufactured (molded) using an injection molding method, without increase in material cost and reduction in the internal volume of the container main assembly, making it easier to find and choose flame resistant substances suitable as the material for the developer supply container.

Further, even after the developer in the developer supply container agglomerates and/or becomes compacted in the developer supply container because the developer supply container is subjected to the vibrations during the shipment of the developer supply container and/or because the developer supply container is stored unattended under harsh conditions, the developer is loosened and fluffed by the vertical gap between each conveyance rib in the top member of the developer supply container main assembly and the corresponding conveyance rib in the bottom member, being thereby enabled to be smoothly discharged through the developer outlet.

Moreover, the developer conveyance range, in terms of the rotational axis of the rotary type developing apparatus, of each conveyance rib overlaps with those of the adjacent conveyance ribs (if image of conveyance rib on top side is projected onto corresponding ribs on bottom side). Therefore, the developer is prevented from slipping through the vertical gap between the adjacent two conveyance ribs. Therefore, the developer is conveyed at a higher speed, and is discharged at a higher speed.

Further, the developer is efficiently loosened and fluffed by the presence of the vertical gaps between the adjacent two conveyance ribs, being therefore smoothly discharged through the developer outlet.

Further, the structural design of the developer supply container main assembly in this embodiment is such that the developer supply container can be formed by joining two members molded by an injection molding method. Therefore, the developer supply container in this embodiment can be inexpensively manufactured.

After being conveyed to the adjacencies of the developer outlet by the conveyance ribs, all of the given portions of the body of developer are not immediately conveyed to the developer outlet. Instead, it is made to detour before it is discharged. Therefore, the developer outlet is prevented from being blocked by the portion of the body of developer having arrived at the developer outlet. The redirected portion of the body of developer is further stirred before it is guided toward the developer outlet. Thus, it will be smoothly discharged upon its arrival at the developer outlet.

The developer supply container is orbitally moved with the utilization of the rotation of the rotary type developing apparatus, making it unnecessary to provide the developer supply container with members for conveying and discharging the developer, and the structure for receiving the force for rotationally driving the developer supply container, reducing thereby not only the developer supply container cost, but also the cost of the image forming apparatus main assembly.

The limited internal space of the rotary type developing apparatus is efficiently used by giving to the main assembly of the developer supply container, such a configuration that makes the cross section of the container main assembly noncircular. Therefore, the developer capacity of the developer supply container is greater compared to that of a developer supply container in accordance with the prior art.

The angle of each conveyance rib relative to the rotational axis of the rotary type developing apparatus is in a range of 20°–70°, generating thereby a desirable amount of developer conveyance force.

Further, the force which the developer layer receives as the developing apparatus is rotated changes in direction as the developing apparatus is rotate. Therefore, the developer layer is more efficiently fluidized by this force, and therefore, the developer is discharged in a more desirable manner. More concretely, as the developer is conveyed, it is repeatedly subjected to a combination of a compression process and a expansion process. As a result, the developer is fluffed up with air; it is fluidized. In other words, the developer is improved in dischargeability.

(Embodiment 3)

Next, the third embodiment of the present invention will be described, in which the main assembly of a developer supply container is reduced in diameter across the range in which the developer outlet is present. First, however, the details of the developer supply container will be given again.

(Container Main Assembly)

To described again the shape of the container main assembly 2, the container main assembly 2 comprises a larger diameter portion 2L and a smaller diameter portion 2S. In terms of the sectional view, the large diameter portion 2L is a combination of a semicircle with an external diameter of 36 mm and a parallelepiped, whereas the smaller diameter portion 2S is a combination of a semicircle with an external diameter of 25 mm and a parallelepiped. The overall length of the container main assembly 2 is roughly 350 mm. The length of the small diameter portion 2S, the peripheral wall of which has a developer outlet 2*a*, is roughly 110 mm, and the length of the large diameter portion 2L is roughly 240 mm. At the joint between the smaller and larger diameter portions, there is a step between the internal surfaces of two semicircular portions, but there is no step between the internal surfaces of the two parallelepipedic portions. In other words, the internal surfaces of the parallelepipedic portions of the larger and smaller diameter portions 2L and 2S form a flat surface virtually parallel to the rotational axis of the rotary type developing apparatus ("virtually parallel" does not means "perfectly parallel", and means "small amount of error is permissible").

(Shutter Guides)

Figure 19:
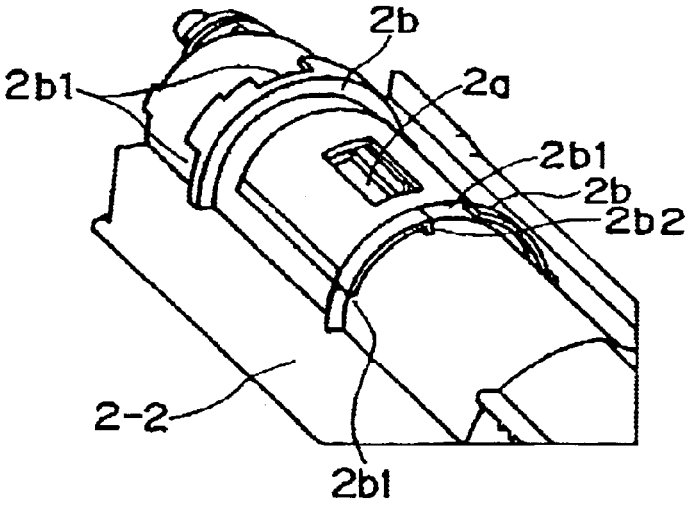
FIG. 19 is a perspective view of the shutter guide of the container main assembly, showing the structure thereof.

FIG. 19 shows the details of the shutter guide. The shutter guides 2*b* are disposed next to the developer outlet 2*a* of the container main assembly 2, and are a pair of parallel ribs shaped so that their cross sections look like a key. The shutter 3 is engaged with these shutter guides 2*b* so that it can be moved about the axial line of the aforementioned semicircular portion of the container main assembly 2, following the curvature of the semicircular portion. Each shutter guide 2*b* has two recesses 2*b*1 and an engagement rib 2*b*2. The recess 2*b*1 is for engaging the shutter 3 with the shutter guide 2*b*, and the engagement rib 2*b*2 is for regulating the movement of the shutter 3 when sealing or unsealing the developer supply container, and also for preventing the shutter guide 2*b* from being bent in the vertical direction when the developer supply container is subjected to impacts, for example, when it is accidentally dropped. With the presence of these engagement ribs 2*b*2, the developer did not leak even when the developer supply container was subjected to the impacts resulting from the falling, or the like, of the developer supply container.

(Knob Guide)

The knob guide 2*c* is a disk-like rib, and is located at one of the lengthwise end portions of the container main assembly 2. The knob 5 is attached to the container main assembly 2 by engaging the claw portion of the knob 5 (FIG. 2) with the knob guide 2*c* in the form of a disk.

(Conveyance Ribs)

The container main assembly 2 has a plurality of conveyance ribs 2*d* for conveying the developer in the container main assembly 2 toward the developer outlet 2*a*. The conveyance ribs 2*d* are erected in parallel on the internal surface of the peripheral walls of the container main assembly 2. More specifically, the plurality of conveyance ribs 2*d* are grouped into two sets: the top and bottom sets separated in terms of the circumferential direction perpendicular to the lengthwise direction of the container main assembly 2. The conveyance ribs 2*d* belonging to the large diameter portion 2L are 5 mm in height, and 1 mm in thickness, whereas the conveyance rib belonging to the smaller diameter portion of the container main assembly 2 having the developer outlet are 2.5 mm in height. The number of the conveyance ribs, as the second set of conveyance ribs, of the top member 2-1 as the second member of the container main assembly is 6 and the number of the conveyance ribs, as the first set of conveyance ribs, of the bottom member 2-2 as the first member of the container main assembly is 7 (FIGS. 4 and 5).

FIG. 4 is a drawing for describing the top and bottom members 2-1 and 2-2 of the developer supply container main assembly, as seen from the direction in which metallic molds are removed during the molding thereof.

The each of the conveyance ribs 2*d* of the top and bottom members of the container main assembly is tilted so that the developer outlet side of the rib 2*d* constitutes the trailing side of the rib 2*d* in terms of the orbital direction of the developer supply container. Next, referring to FIG. 4, the manner in which each conveyance rib 2 is tilted will be described in detail.

Referring to FIG. 4, in the case of the conveyance ribs of the bottom member 2-2 of the container main assembly 2, on the right side of the developer outlet 2*a*, their left side is where the developer outlet 2*a* is. Thus, they are tilted so that their left side will be on the trailing side with respect to the direction in which the container main assembly is orbitally moved. In FIG. 4, the orbital direction is downward. Thus, the conveyance ribs on the right side of the developer outlet 2*a* are such ribs that are tilted so that their left end portions are raised relative to their right end portions, in the drawing. In comparison, in the case of the conveyance rib on the left side of the developer outlet 2*a*, its right side is where the developer outlet 2*a* is. Thus, the conveyance ribs on the left side of the developer outlet 2*a* are such ribs that is tilted so that its right end portions are raised relative to its their left end portions, in the drawing.

Each of the conveyance ribs in the top and bottom members 2-1 and 2-2 of the container main assembly is in the form of a piece of flat plate. In other words, it has such a shape that appears like a straight line, as seen the from the removal direction of the metallic molds during the molding of the top and bottom members 2-1 and 2-2.

Referring to FIG. 4, the positional relationship between the set of conveyance ribs 2*d* in the top member 2-1 of the container main assembly 2, and the set of conveyance ribs 2*d* in the bottom member 2-2 of the container main assembly 2, is as shown in the drawing. In other words, in terms of the axial direction of the rotary type developing apparatus, the conveyance ribs 2*d* in the top members 2-1 of the container main assembly 2 and the conveyance ribs 2*d* in the bottom member 2-2 of the container main assembly 2 are alternately positioned, whereas in terms of the direct-ion perpendicular to the axial direction of the rotary type developing apparatus, the conveyance rib 2*d* and conveyance rib 2*d* partially overlap by their lengthwise end portions. The amount of the overlap (measurement of X in drawing), which here is measured as the length of the projection of any of the overlapping portions of the conveyance rib 2*d* and conveyance rib 2*d*, upon the cylindrical wall of the container main assembly, is roughly 5 mm. Therefore, it is assured that after being conveyed a certain distance by the conveyance ribs 2*d* of the top member 2-1, the developer particles are further conveyed by the conveyance ribs 2*d* of the bottom member 2-2, and then, after being conveyed a certain distance by the conveyance ribs 2*d* of the bottom member 2-2, they are further conveyed by the conveyance ribs 2*d* of the top member 2-1. In other words, the developer particles are conveyed toward the developer outlet through the alternate repetition of the above described conveyance processes.

Referring to FIG. 4, the angle Y of the conveyance ribs 2*d* relative to the rotational axis of the rotary type developing apparatus is desired to be in a range of 20°–70°, preferably, in a range of 40°–50°. In this embodiment, it is 45°.

The relationship between the developer outlet 2*a* and the conveyance rib 2*d*-1 next to the developer outlet 2*a* is as shown in FIG. 5. That is, the conveyance rib 2*d*-1 is connected to the upstream side of the developer outlet 2*a*. Therefore, after being conveyed to the adjacencies of the developer outlet 2*a*, the developer in the container main assembly are not immediately discharged from the developer outlet 2*a* as the developer supply container is orbitally moved. Instead, the developer remains in the range in which the developer outlet 2*a* is, and is further stirred, being enabled to be more easily discharged.

(Shutter)

Figure 20:
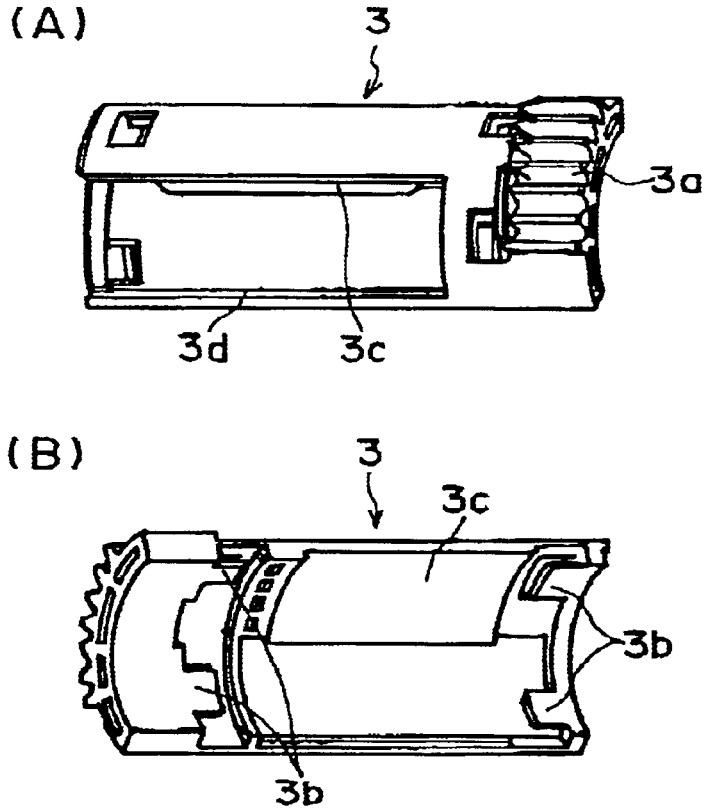
FIGS. 20(A) and 20(B) are perspective view of the outward and inward sides, respectively, of the shutter.

Next, referring to FIGS. 20(A) and 20(B), the details of the shutter 3 will be described. Referring to FIG. 20, the shutter 3 is in the form of a piece of arcuate plate, the curvature of which matches the curvature of the peripheral surface of the contain main assembly 2, and the two opposing edges of which are bent in the form of a letter U, constituting guiding portions, whereas the container main assembly 2 is provided with a pair of parallel shutter guides 2*b*, which extend on the external surface of the container main assembly 2, in the direction perpendicular to the lengthwise direction of the container main assembly 2, in a manner to sandwich the developer outlet. The shutter 3 is attached to the container main assembly 2 by moving the shutter 3 so that the pair of parallel shutter guides 2*b* slide into the U-shaped grooves of the shutter 3, one for one, allowing the shutter 3 to be moved in the direction perpendicular to the lengthwise direction of the container main assembly 2, following the curvature of the peripheral surface of the container main assembly 2.

In this embodiment, the developer supply container becomes unsealed as the shutter 3 is moved in the direction indicated by an arrow mark in FIG. 2.

Between the shutter 3 and container main assembly 2, a sealing member 4 is disposed, hermetically sealing the developer outlet 2*a* by remaining compressed by the shutter 3.

The one end of the shutter 3 is provided with a shutter gear 3*a*. As the shutter gear 3*a* is rotated by the rotational force which the shutter gear 3*a* receives from the driving force transmission gear on the image forming apparatus main assembly side, the shutter 3 is orbitally moved. As a result, the opening of the developer outlet is unsealed.

The shutter 3 is provided with a bridge-like portion 3*d*, which increases the strength of the shutter 3*a*.

The shutter 3 is provided with a shutter sheet 3*c*, which is pasted to the shutter 3 with the use of double-sided adhesive tape. As for the material for the shutter sheet 3*c*, a piece of single or compound layers, as substrate, of polyester, biaxially oriented polypropylene (OPP), polyamide, polyethylene, or fluorinated resin, the surface of which is coated with silicone oil, silicone wax, siliconized paint, or the like, is used.

With the combination of the above described structural arrangement and materials, the siliconized paint, on the surface of the shutter sheet 3*c*, is present in the contact area between the sealing member 4 and shutter sheet 3*c*. Therefore, the amount of the force necessary to unseal the container main assembly is relatively small in spite of the structural arrangement which keeps the sealing member 4 compressed against the container main assembly (Manufacturing Method for Shutter)

The shutter 3 is desired to be formed of plastic with the use of an injection molding method. However, other materials and other methods may be used. As the material for the shutter 3, a substance, the rigidity of which is greater than a certain level, is preferable. In this embodiment, it is molded using the combination of highly slippery ABS resin and an ejection molding method. Then, the shutter sheet 3*c* is pasted to the molded piece to complete the shutter 3.

(Method for Attaching Shutter 3)

Figure 21:
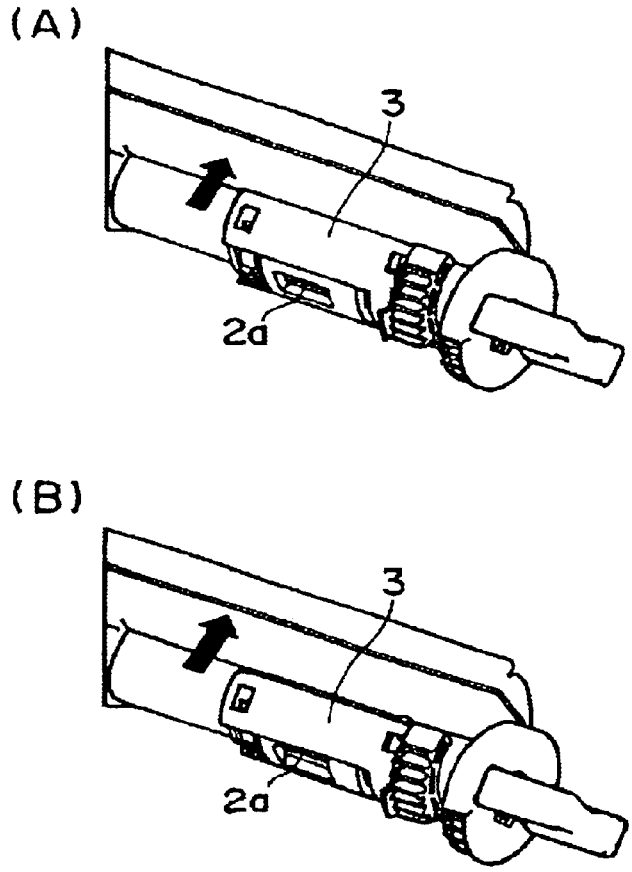
FIG. 21(A) is a drawing for showing where the shutter is attached.
FIG. 21(B) is a drawing showing the position to which the shutter is moved to expose the developer outlet.
Figure 22:
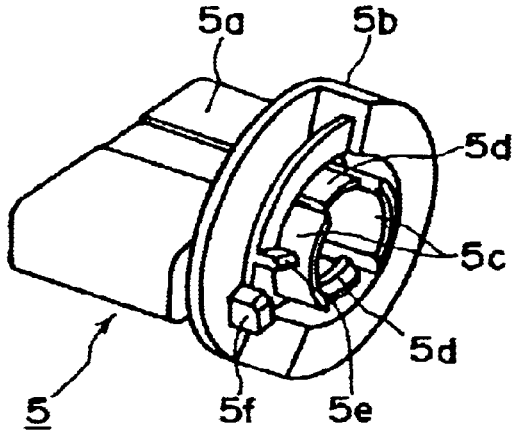
FIG. 22 is a perspective view of the knob.

The shutter 3 is attached in the following manner. In the case of the container main assembly 2 in this embodiment, the smaller diameter portion, that is, the first portion, has the developer outlet 2*a*, preventing the shutter 3 from being ordinarily attached from the end. Thus, each shutter guide 2*b* is provided with a recess 2*b*1 (FIG. 19). In order to attach the shutter 3 to the container main assembly 2, first, the shutter 3 is placed against the container main assembly 2 so that it aligns with the theoretical open position (FIG. 21(A)) of the shutter 3, and then, it is slid to the theoretical closed position of the shutter 3. Precisely speaking, the portion of the container main assembly 2, against which the shutter 3 is positioned before it is slid back to the closed position, is slightly off to the downstream side from the theoretical closed position, in terms of the closing direction of the shutter. This structural arrangement is made to prevent the shutter 3 from becoming disengaged during the unsealing operation.

(Sealing Member)

Referring to FIG. 2, the sealing member 4 is disposed in a manner to surround the developer outlet 2*a* of the container main assembly 2, and seals the developer outlet 2*a* by being compressed against the container main assembly 2 by the shutter 3. As the material for the sealing member 4, one of various well-known foamed substances or elastic substances can be used. In this embodiment, foamed polyurethane is used.

(Knob)

Also referring to FIG. 2, the details of the knob 5 will be described. The knob 5 comprises a knob proper portion 5*a* and a double-walled cylindrical portion 5*c*. A part 5*b* of the external surface of the external wall of the double-walled cylindrical portion is shaped in the form of a gear (5*b*), and a part of the internal surface of the internal wall of the double-walled cylindrical portion is provided with a claw 5*d*, which engages with knob guide 2*c* (FIG. 3) on the end portion of the container main assembly 2. This claw 5*d* is used to attach the knob 5 to the front end portion of the container main assembly 2 so that the knob proper portion 5*a* can be rotated about the axial line of the double-walled cylindrical portion, along with the cylindrical portion.

The knob 5 also comprises a knob locking portion 5*e* and a knob unlocking portion 5*f*, which are on the opposite side of the knob 5 with respect to the knob gear 5*b*. The knob locking portion 5*e* engages with the locking projection on the container main assembly side, preventing the knob 5 from rotating during the shipment. As the developer supply container is mounted into a developing device, the knob unlocking portion 5*f* of the knob 5 engages with the projection on the developing device side, and is moved toward the knob 5. As a result, the knob locking portion 5*e* is disengaged from the locking projection on the container main assembly side, allowing the knob 5 to be rotated.

(Method for Manufacturing Knob)

The knob 5 is also desired to be manufactured with the use of the combination of plastic and an injection molding method, as is the shutter 3. In this embodiment, it was manufactured with the use of the combination of shock resistant polystyrene and an injection molding method.

At this time, the effects of the shape (reduction of internal diameter, across range in which developer outlet is present) of a developer supply container (container main assembly) upon the manner in which developer is discharged from the developer supply container will be described with reference to the test carried out to verify the effects.

(Test)

The following test was carried out to verify that, in terms of the manner in which developer is discharged from a developer outlet, a developer supply container structured so that the main assembly 2 of the developer supply container essentially comprises a larger diameter portion 2L having no developer outlet and a smaller diameter portion 2S having a developer outlet, and also so that across a certain range of the circumferential direction of the joint between the larger and smaller diameter portions 2L and 2S, the internal surfaces of the larger and smaller diameter portions 2L and 2S are level, is superior to a developer supply container having no small diameter portion.

Figure 23:
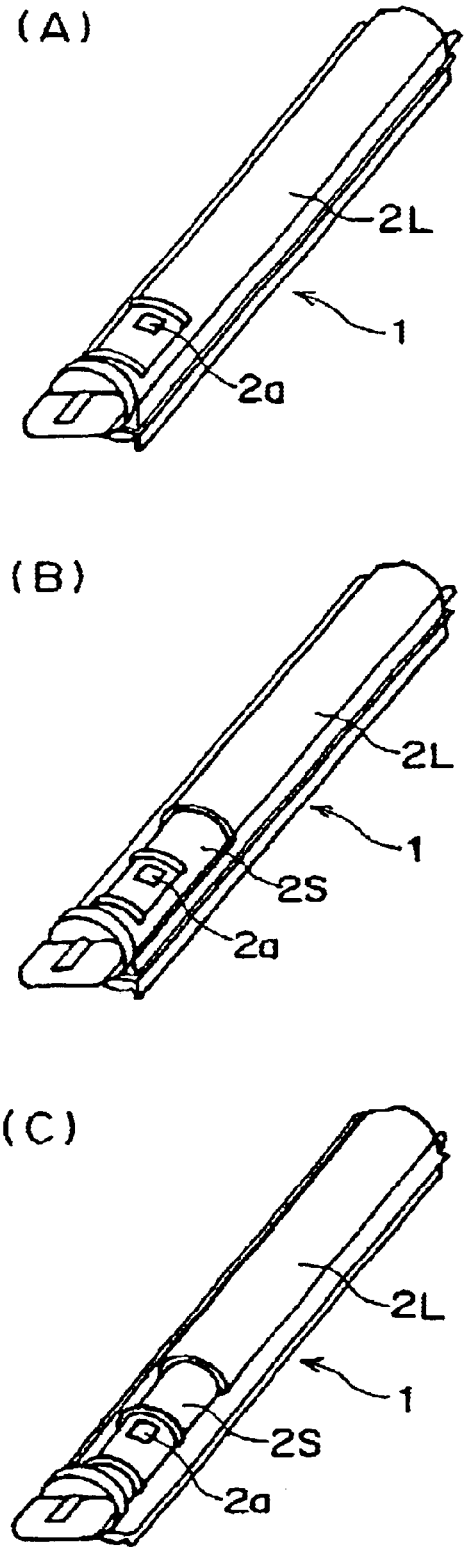
FIGS. 23(A), 23(B), and 23(C) are a perspective view of the developer supply container having no small diameter portion(internal diameter ϕ of 36), perspective view of the developer supply container having a small diameter portion (internal diameter ϕ of 34), and perspective view of the developer supply container having a small diameter portion (internal diameter ϕ of 25), respectively.

This test was carried out using three developer supply containers, that is, a developer supply container (ϕ 36) with no smaller diameter portion, a developer supply container with a smaller diameter portion (ϕ 31), and a developer supply container with a smaller diameter portion (ϕ 25). The perspective views of the developer supply containers used in this test are given in FIG. 23, in which 23(A), 23(B), and 23(C) represent the developer supply container (ϕ 36) with no smaller diameter portion, developer supply container with a smaller diameter portion (ϕ 31), and developer supply container with a smaller diameter portion (ϕ 25).

Three developer supply containers (A), (B), and (C) were filled with developer so that they became equal in the bulk density of the developer therein at 0.43 g/cc (A: 185 g; B: 178 g; and C: 170 g), and were tested for developer discharge performance, with the use of a jig, a simplified form of the rotary type developing apparatus, (created by removing the developing devices from the rotary type developing apparatus so that the amount of the developer discharged from the developer outlet 2*a* of each developer supply container can be directly measured). The incremental rotational angle of the jig was set to 90° (90°×4; 90°→90°→90°→90°). Its moving time per 90° was set to roughly 0.3 second, and the time during which the jig was kept stationary for image formation was set to roughly 1.2 second. The peripheral velocity of the jig during its movement for developing device switch was set to approximately 0.7 m/second, and the diameter ϕ of the jig was 190 mm.

(Results)

With respect to the amount of the developer remaining in the developer supply container after the effective developer depletion from the developer supply container (discharging of developer was stopped when amount of developer discharged per incremental rotation of developing apparatus fell below 0.1 g), there were no differences among the above described three developer supply containers. However, the total number of rotations the container with no smaller diameter portion shown in FIG. 23(A) required to be depleted of the developer therein was roughly 120 times, whereas those for the developer supply container with the smaller diameter portion (internal diameter ϕ 31) in FIGS. 23(B) and developer supply container with the smaller diameter portion (internal diameter ϕ 25) in FIG. 23(C) in accordance with the present invention were roughly 110 times and 70 times, respectively.

Figure 24:
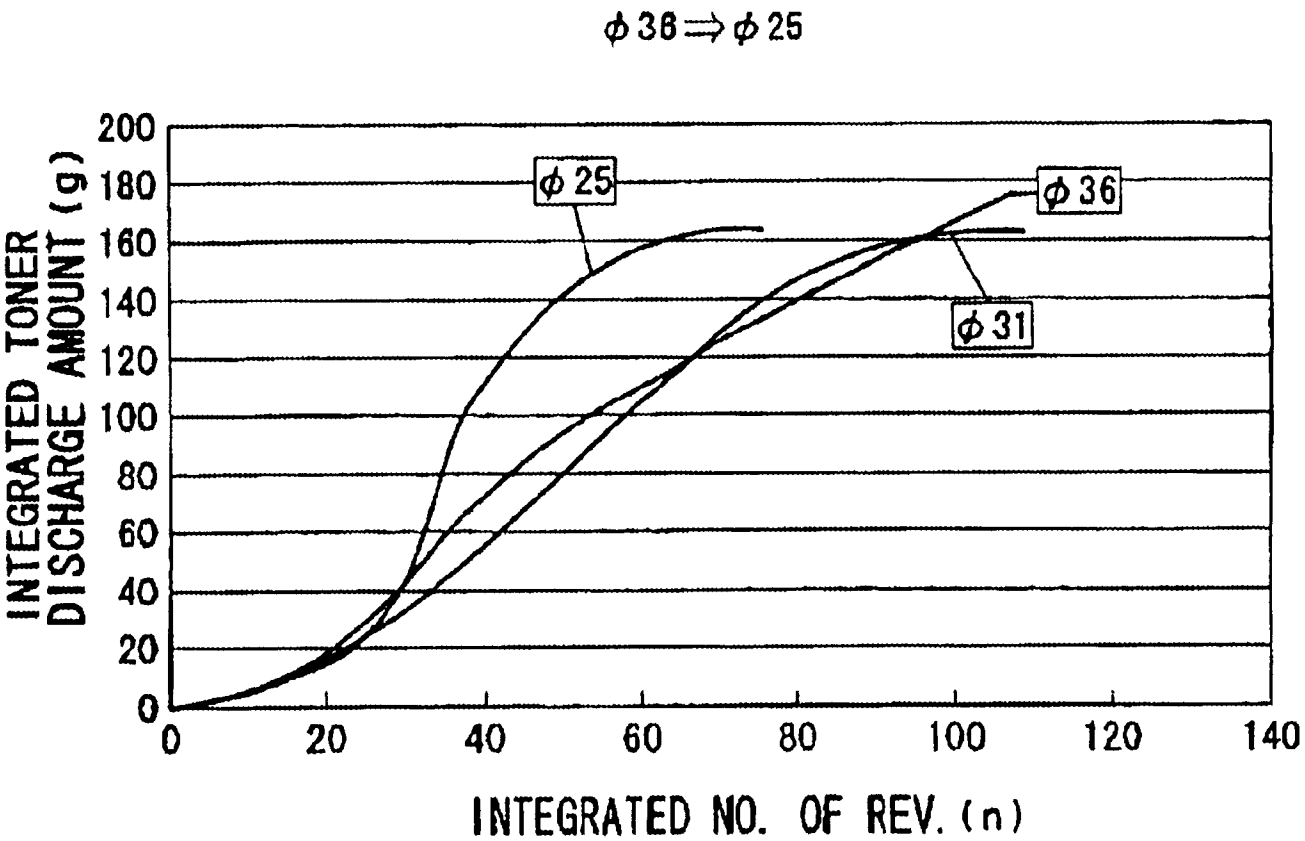
FIG. 24 is a graph showing the relationship between the cumulative amount of toner discharged from each of the three developer supply containers and cumulative number of rotations of the rotary type developing apparatus.

The results of this test were given in the form of a graph, in FIG. 24. It is evident from this graph that the ascending order of the three developer supply containers in terms of the developer discharge performance is: developer supply container with no smaller diameter portion→discharge supply container with small diameter portion (internal diameter ϕ 31)→developer supply container with smaller diameter portion (internal diameter ϕ 25).

(Analysis)

Figure 25:
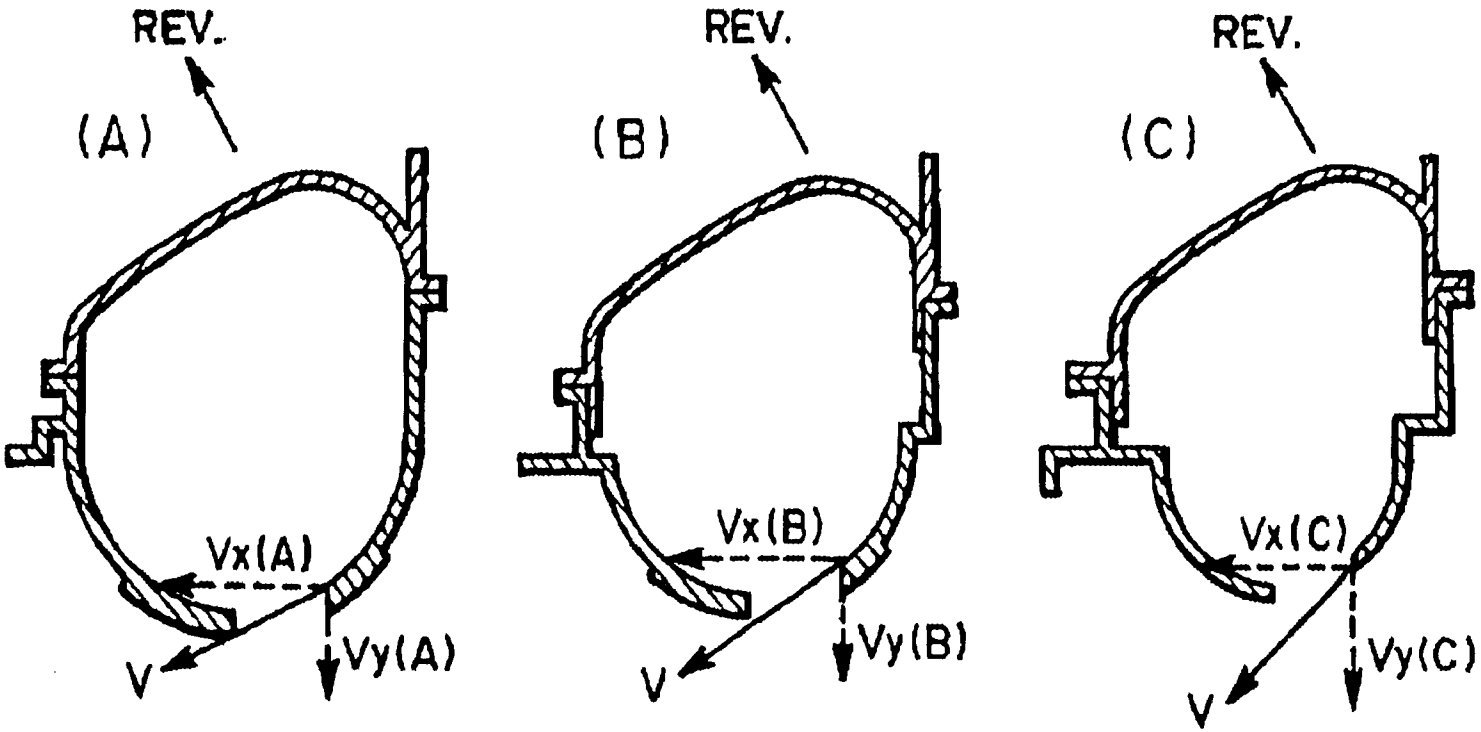
FIGS. 25(A) and 25(B) are drawings for showing the ratio between the developer outlet and container proof of the developer supply container.

Next, the reasons for the above described results will be described based on the shapes of the developer supply containers The ratio of the developer outlet 2*a* to the developer storage portion of the developer supply container 1 was increased by reducing the diameter of the section (first section) of the developer supply container 1, having the developer outlet 2*a*, to that of the other section (second section). Therefore, the developer discharge performance increased. FIGS. 25(A), 25(B), and 25(C) are sectional views of the developer supply containers shown in FIGS. 23(A), 23(B), and 23(C), at planes perpendicularly intersectional to the corresponding developer outlets 2*a*, respectively. The developer in each of the developer supply containers is conveyed to the adjacencies of the developer outlet, by the orbital movement of the developer supply container, and then, is discharged through the developer outlet. In the drawing, V stands for the velocity of the developer in the develop supply container during this orbital movement of the developer supply container 1; Vx stands for the horizontal component of V; and Vy stands for vertical component of V, that is, the component which acts in the direction to cause the developer to fall. The greater the ratio of the developer outlet 2*a* relative to the developer storage portion, the greater the component Vy. Thus, the greater the ratio of the developer outlet 2*a* relative to the developer storage portion, the greater the developer discharge performance. Further, in a certain range in terms of the circumferential direction of the developer supply container 1, the internal surface of the larger diameter portion 2L of the developer supply container 1 is level with that of the smaller diameter portion 2S of the developer supply container 1, allowing the developer to be smoothly conveyed from the larger diameter portion 2L to the smaller diameter portion 2S. Thus, the above described results were thought to have come from the synergetic effects of these two aspects of the structural arrangement in this embodiment. In addition, even if the developer is in the agglomerated state, the presence of step (vertical distance) between the internal surface of the larger diameter portion 2L and that of the smaller diameter portion 2L, in the range, other than the range in which the two surfaces are level, in terms of the circumferential direction of the developer supply container 1, loosens, fluidizing thereby, the agglomerated developer, adding thereby to the effects of the above described two aspects of the structural arrangement in this embodiment.

As described above, in this embodiment, the developer in the agglomerated state is loosened, that is, fluidized, by the stepped portion between a portion of the internal surface of the larger diameter portion 2L of the developer supply container 1 and a portion of the internal surface of the smaller diameter portion 2S of the developer supply container 1; the level connection between the other portion of the internal surface of the larger diameter portion 2L of the developer supply container 1 and the other portion of the internal surface of the smaller diameter portion 2S of the developer supply container 1 allows the developer to be smoothly conveyed from the large diameter portion 2L to the smaller diameter portion 2S; and the developer is smoothly discharged from the developer outlet 2*a* located in the semicylindrical wall portion of the smaller diameter portion 2S of the developer supply container 1. Thus, the employment of this embodiment of a developer supply container in accordance with the present invention will improve the developer discharge performance of a developer supply container without the cost increase traceable to the increase in component count, without increase in apparatus size, and without structural complication.

Also in the preceding embodiments, the cross section of the container main assembly 2 is noncircular, contributing thereby to the efficient utilization of the limited internal space of the rotary type developing apparatus. In other words, the embodiments increase the amount by which developer can be filled in each developer supply container, while leaving a rotary type developing apparatus unchanged in shape and internal space.

(Embodiment 4)

Next, referring to FIGS. 26(A) and 26(B), of the modifications of the preceding embodiments of the present invention will be described.

The developer supply container in this modification of one of the preceding embodiments comprises the developer supply container in the preceding embodiment, and a plurality of baffling plates 12, as stirring plates, in the form of a rib, which are protruding from the internal surface of the developer supply container, being aligned in the direction roughly parallel to the developer conveyance direction. The perspective views of the top and bottom members 2-1 and 2-2 of this developer supply container are given in FIG. 26(A). The structures of the portions of this developer supply container other than the top and bottom members 2-1 and 2-2 are the same as those of the developer supply container in the first embodiment, and therefore, will not be described here.

In this modification, the four baffling plates 12 are provided, which are disposed, one for one, in the four intervals of the conveyance ribs 2*d* of the top member 2-1 of the developer supply container.

(Baffling Plates)

Figure 26:
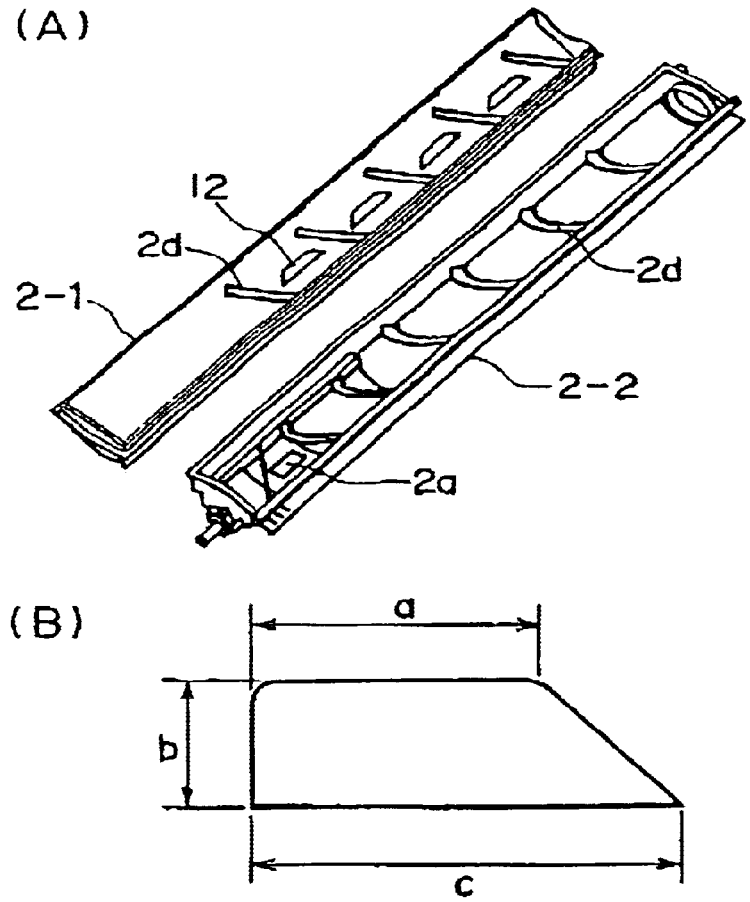
FIGS. 26(A) and 26(B) are drawings for showing the structures of the top and bottom members of the main assembly of the developer supply container, and the detailed drawing of the baffling plates.

Referring to FIG. 26(B), the baffling plates 12 will be described in detail. The measurements of the baffling plate 12 is as follows: a is 20 mm; b (height) is 10 mm; and c is 30 mm. The b side of the baffling plate 12 is the knob side, and the slanted edge side of the baffling plate 12 is the side corresponding to the developer inlet of the developer supply container.

This structural arrangement does not interfere with the filling of the developer into the developer supply container through the developer inlet located on the opposite side of the developer supply container with respect to the knob; it allows the developer to be smoothly filled in spite of the presence of the baffling plates 12.

The provision of the plurality of ribs, as baffling plates 12, effective to stir the developer, in the intervals of the conveyance ribs 2*d*, one for one, further improves the developer fluidity, stabilizing the developer discharge performance.

(Embodiment 5)

Figure 27:
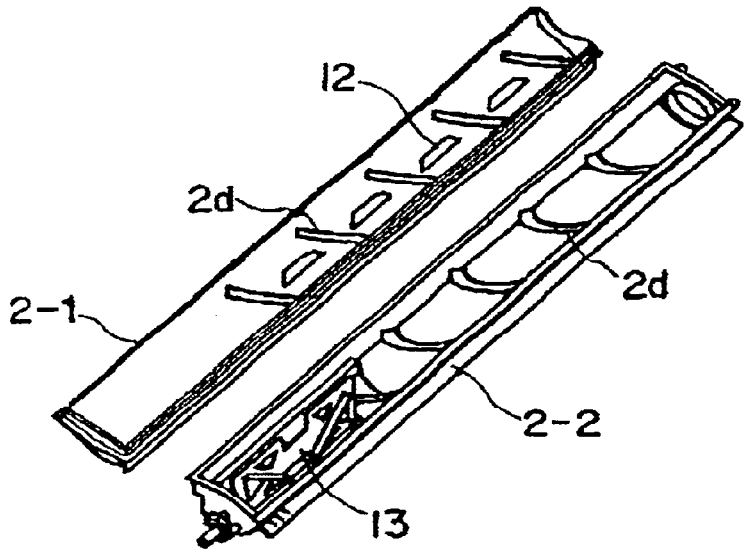
FIG. 27 is a drawing for showing the structure of the top and bottom members of the main assembly of the developer supply container.

Next, referring to FIGS. 27 and 28, another modification of the preceding embodiments will be described.

The developer supply container in this modification comprises one of the developer supply containers in the preceding embodiment, and a baffling member 13, as an additional stirring member, which is nonrotationally disposed adjacent to the developer outlet of the developer supply container. The perspective views of the top and bottom members 2-1 and 2-2 of this developer supply container are given in FIG. 27. The structures of the portions of this developer supply container other than the top and bottom members 2-1 and 2-2 are the same as those in the above described first and second embodiments, and therefore, will not be described.

(Baffling Member)

The baffling member 13 comprises: a baffler proper portion, as a lifting portion, for lifting the developer as the developer supply container is orbitally moved; a guiding portion for guiding downward the developer lifted by the baffler proper portion, as the developer supply Container is orbitally moved; a tilted plate portion 13*a* as a guiding portion for guiding downward, that is, toward the developer outlet (developer outlet 2*a*), the developer lifted by the baffler proper portion, as the developer supply container is orbitally moved; and a hole 13*b*, as a passage, through which the developer lifted by the baffler proper portion falls, without being conveyed toward the developer outlet (developer outlet 2*a*), as the developer supply container is orbitally moved.

Figure 28:
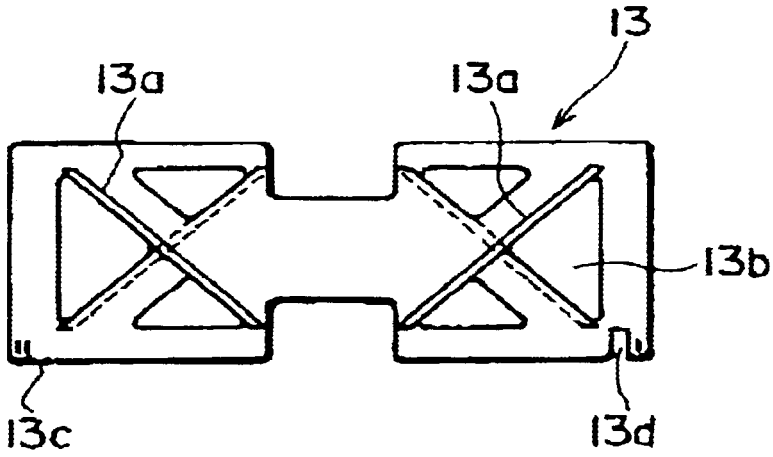
FIG. 28 is a detailed drawing of the baffling member.

FIG. 28 is a side view of the baffling member 13. The baffling member 13 comprises: the above described tilted plate portion 13*a* as a guiding portion; hole 13*b* as the developer passage; an anchor rib 13*c*; and a recess 13*d*. The baffling member 13 is orbitally moved by the rotation of the rotary type developing apparatus, while lifting the developer in the developer supply container by the baffler proper portion. A part of the lifted developer falls through the hole 13*b* after sliding on the baffling member 13, and the rest is conveyed toward the developer outlet by the tilted plate portion 13*a*.

Figure 29:
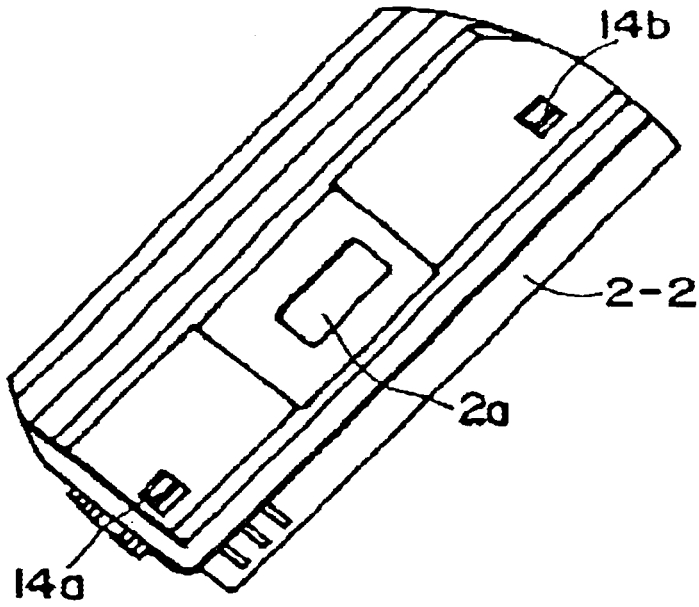
FIG. 29 is a detailed drawing of the baffling member anchoring portion of the developer supply container (bottom member).

Next, referring to FIGS. 28 and 29, the method for fixing the baffling member 13 to the developer supply container (bottom member 2-2) will be described. In order to attach the baffling member 13 to the developer supply container, the anchoring rib 13*c* of the baffling member 13 is engaged with a U-shaped rib 14*a* of the bottom member 2-2 of the container main assembly, and a square anchor rib 14*b* of the bottom member 2-2 of the container main assembly is engaged with the recess 13*d* of the baffling member 13 correspondent to the square rib 14*b*. This arrangement assures that the baffling member 13 is accurately attached to the bottom member 2-2 of the container main assembly; it prevents the baffling member 13 from being reversely attached.

Attaching the baffling member 13 to the adjacencies of the developer outlet (developer outlet 2*a*) assures that even after a developer supply container is subjected to harsh conditions, for example, high temperature, high humidity, severe vibrations, etc., during its shipment, the developer in the developer supply container is smoothly discharged through the developer outlet.

Incidentally, the structure of a developer supply container does not need to be limited to the structures in the above described embodiments; it may be such that, in terms of the lengthwise direction of the developer supply container, the portion of the container main assembly smaller in diameter than the rest of the container main assembly may be only as wide as the developer outlet.

Heretofore, various embodiments of the present invention were described. However, the gist and scope of the present invention are not limited to the specific descriptions and drawings given in this specifications of the present invention. Hereafter, examples of the embodiment of the present invention, other than the above described ones, will be listed.

As described above, according to the third to fifth embodiments of the present invention, the portion of the container main assembly of a developer supply container, having the developer outlet, is reduced in diameter. Therefore, the ratio of the size of the opening of the developer outlet relative to the size of the internal surface of this portion of the container main assembly is greater compared to a developer supply container in accordance with the prior art. Therefore, the developer supply containers in accordance with the third to fifth embodiments of the present invention are superior in the developer discharge performance to a developer supply container in accordance with the prior art.

Further, the developer in the agglomerated state is loosened, that is, fluidized, by the stepped portion between a portion of the internal surface of the larger diameter portion of the main assembly of the developer supply container and a portion of the internal surface of the smaller diameter portion of the main assembly of the developer supply container. Moreover, the flush connection between the other portion of the internal surface of the larger diameter portion of the main assembly of the developer supply container and the other portion of the internal surface of the smaller diameter portion of the main assembly of the developer supply container allows the developer to be smoothly conveyed from the large diameter portion to the smaller diameter portion. Further, the developer outlet 2*a* is located in the semicylindrical wall portion of the smaller diameter portion of the main assembly of the developer supply container. Therefore, after being smoothly conveyed as described above, the developer is smoothly discharged through the developer outlet.

In other words, even if the efficiency with which the developer is discharged through the developer outlet of a developer supply container is improved while maintaining the developer capacity of the developer supply container, the developer therein is conveyed in a desirable manner.

To put it in another way, the employment of this embodiment of a developer supply container in accordance with the present invention will improve the developer discharge performance of a developer supply container without the cost increase traceable to the increase in component count, without increase in apparatus size, and without structural complication.

While the invention has been described with reference to the structures disclosed herein, it is not confined to the details set forth, and this application is intended to cover such modifications or changes as may come within the purposes of the improvements or the scope of the following claims.

What is claimed is:

1. A developer supply container for supplying a developer detachably set in an image forming apparatus, said developer supply container comprising:

a main body for containing the developer;

a discharge opening, which is provided in said main body, for discharging the developer; and a plurality of feeding projections, which are disposed indpendently from each other so as to project from a curved inner surface of said main body, for feeding the developer in said main body toward said discharge opening with rotation of said main body, wherein each of said plurality of feeding projections is linear without being twisted, wherein adjacent ones of said plurality of feeding projections include portions, which overlap each other as seen in a direction perpendicular to a direction of an axis of rotation of said main body.

2. A developer supply container for supplying a developer detachably set in an image forming apparatus, said developer supply container comprising:

a main body for containing the developer;

a discharge opening, which is provided in said main body, for discharing the developer; and a plurality of feeding projections, which are disposed independently from each other so as to project from a curved inner surface of said main body, for feeding the developer in said main body toward said discharge opening with rotation of said main body, wherein each of said plurality of feeding projections is linear without being twisted, wherein said main body is produced by injection molding, and is constituted by connecting first and second members each of which is provided with said plurality of feeding projections.

3. A developer supply container for supplying a developer detachably set in an image forming apparatus, said developer supply container comprising:

a main body for containing the developer;

a discharge opening, which is provided in said main body, for discharging the developer; and a plurality of feeding projections, which are disposed independently from each other so as to project from a curved inner surface of said main body, for feeding the developer in said main body toward said discharge opening with rotation of said main body, wherein each of said plurality of feeding projections is linear without being twisted, wherein said plurality of feeding projections are inclined at an angle of 20–70 degrees relative to an axis of rotation of said main body.

4. A developer supply container for supplying a developer detachably set in an image forming apparatus, said developer supply container comprising:

a main body for containing the developer, wherein said main body is constituted by combining first and second members so as to be opposed to each other, and wherein said first and second members extend in a longitudinal direction;

a discharge opening, which is provided in a peripheral surface of said first member, for discharging the developer;

a first feeding portion, which is provided on an inner surface of said first member, for feeding the developer toward said discharge opening; and a second feeding portion, provided on an inner surface of said second member, wherein a diameter of at least a part of said first member is reduced to provide a diameter-reduced portion in a region where said discharge opening is provided.

5. A developer supply container for supplying a developer detachably set in an image forming apparatus, said developer supply container comprising:

a main body for containing the developer;

a discharge opening, which is provided in said main body, for discharging the developer;

a plurality of feeding projections, which are disposed independently from each other so as to project from a curved inner surface of said main body, for feeding the developer in said main body toward said discharge opening with rotation of said main body; and a conveyance projection for conveying the developer from said discharge opening toward a downstream side with respect to a feeding direction of said plurality of feeding projections after the developer is fed by rotation of said main body toward said discharge opening, which is formed in a peripheral surface of said main body.

6. A developer supply container according to claim 5, further comprising a returning portion, which is provided in said main body, for refeeding the developer conveyed by said conveyance projection toward said discharge opening with rotation of said main body.

* * * * *

UNITED STATES PATENT AND TRADEMARK OFFICE

CERTIFICATE OF CORRECTION

PATENT NO. : 6,963,713 B2
DATED : November 8, 2005
INVENTOR(S) : Tetsuo Isomura et al.

It is certified that error appears in the above-identified patent and that said Letters Patent is hereby corrected as shown below:

Title page,
Item [75], Inventors, "Kazuhiko Omata, Shizuoka-ken," should read -- Kazuhiko Omata, Shizuoka, (JP) --.

Column 1,
Line 67, "2,000-214669" should read -- 2000-214669 --.

Column 2,
Line 10, "rub" should read -- rib --.
Line 33, "containers" should read -- container --.
Line 37, "veyed" should read -- vey --.
Line 54, "2,000-214669" should read -- 2000-214669 --.

Column 3,
Line 46, "containers" should read -- container --.

Column 6,
Line 39, "tone" should read -- toner --.

Column 10,
Line 16, "discharging" should read -- discharge --.
Line 41, "contain" should read -- container --.

Column 11,
Line 66, "rotates" should read -- rotate --.

Column 12,
Line 48, "locations 7b" should read -- locations 7b, --.

Column 13,
Line 32, "Even the" should read -- Even though the --.
Line 46, "second" should read -- seconds --.

Column 14,
Line 49, "apparatus," should read -- apparatus --.
Line 57, "second" should read -- seconds --.

Column 15,
Line 37, "blocks" should read -- block --.
Line 53, "a" (second occurrence) should read -- an --.
Line 67, "vertical," should read -- vertically, --.

UNITED STATES PATENT AND TRADEMARK OFFICE

CERTIFICATE OF CORRECTION

PATENT NO. : 6,963,713 B2
DATED : November 8, 2005
INVENTOR(S) : Tetsuo Isomura et al.

It is certified that error appears in the above-identified patent and that said Letters Patent is hereby corrected as shown below:

Column 18,
Line 55, “second.” should read -- seconds. --.

Column 19,
Line 18, “facsimileing” should read -- facsimile --.

Column 20,
Line 36, “rotate.” should read -- rotated. --.
Line 42, “a” (first occurrence) should read -- an --.
Line 52, “described” should read -- describe --.

Column 21,
Line 46, “rib” should read -- ribs --.
Line 58, “The each” should read -- Each --.

Column 22,
Line 11, “is” should read -- are --.
Line 12, “its” should read -- their -- and “its their” should read -- their --.
Line 26, “members” should read -- member --.
Line 29, “direct-ion” should read -- direction --.
Line 57, “are” should read -- is --.
Line 67, “contain” should read -- container --.

Column 25,
Line 15, “apparatus,” should read -- apparatus --.
Line 24, “second.” should read -- seconds. --.

Column 26,
Line 3, “develop” should read -- developer --.

Column 27,
Line 18, “is” (first occurrence) should read -- are --.
Line 50, “Container” should read -- container --.

Column 28,
Line 30, “specifications” should read -- specification --.

Column 29,
Line 24, “indpendently” should read -- independently --.
Lines 30 and 47, “twisted,” should read -- twisted, and --.
Line 40, “discharing” should read -- discharging --.

UNITED STATES PATENT AND TRADEMARK OFFICE

CERTIFICATE OF CORRECTION

PATENT NO. : 6,963,713 B2
DATED : November 8, 2005
INVENTOR(S) : Tetsuo Isomura et al.

It is certified that error appears in the above-identified patent and that said Letters Patent is hereby corrected as shown below:

Column 30,
Line 7, "twisted," should read -- twisted, and --.

Signed and Sealed this

Thirtieth Day of May, 2006

JON W. DUDAS
*Director of the United States Patent and Trademark Office*